US011304862B2

(12) United States Patent
Mizuno et al.

(10) Patent No.: US 11,304,862 B2
(45) Date of Patent: Apr. 19, 2022

(54) POWER ASSIST WHEELCHAIR, POWER ASSIST UNIT FOR WHEELCHAIR, CONTROL DEVICE FOR POWER ASSIST WHEELCHAIR, CONTROL METHOD FOR POWER ASSIST WHEELCHAIR, PROGRAM, AND TERMINAL

(71) Applicant: Yamaha Hatsudoki Kabushiki Kaisha, Shizuoka-ken (JP)

(72) Inventors: Masamitsu Mizuno, Shizuoka (JP); Masanori Yonemitsu, Shizuoka (JP)

(73) Assignee: YAMAHA HATSUDOKI KABUSHIKI KAISHA, Shizuoka-Ken (JP)

( * ) Notice: Subject to any disclaimer, the term of this patent is extended or adjusted under 35 U.S.C. 154(b) by 288 days.

(21) Appl. No.: 16/647,034

(22) PCT Filed: Sep. 14, 2017

(86) PCT No.: PCT/JP2017/033324

§ 371 (c)(1),
(2) Date: Mar. 13, 2020

(87) PCT Pub. No.: WO2019/053859

PCT Pub. Date: Mar. 21, 2019

(65) Prior Publication Data

US 2020/0253798 A1 Aug. 13, 2020

(51) Int. Cl.
*A61G 5/04* (2013.01)

(52) U.S. Cl.
CPC ..... *A61G 5/04* (2013.01); *A61G 2203/10* (2013.01); *A61G 2203/38* (2013.01); *A61G 2203/44* (2013.01)

(58) Field of Classification Search
CPC .. A61G 5/04; A61G 2203/10; A61G 2203/38; A61G 2203/44
See application file for complete search history.

(56) References Cited

U.S. PATENT DOCUMENTS 5,818,189 A * 10/1998 Uchiyama ..... A61G 5/1054 318/432
6,230,831 B1 * 5/2001 Ogata ..... A61G 5/048 318/60

(Continued)

FOREIGN PATENT DOCUMENTS

CN 102149596 A * 8/2011 ..... A61G 5/04
EP 0945112 A1 9/1999

(Continued)

OTHER PUBLICATIONS

English translation of the Written Opinion of The International Searching Authority (PCT/ISA/237) dated Mar. 17, 2020, for corresponding PCT Application No. PCT/JP2017/033324.

(Continued)

*Primary Examiner* — Jacob B Meyer
(74) *Attorney, Agent, or Firm* — HEA Law PLLC

(57) ABSTRACT

A control device for a power assist wheelchair which includes a compensation turning torque calculation unit that calculates a compensation turning torque value for compensating for at least a part of the shortage or excess of the actual turning torque value with respect to the predicted turning torque value, in which the compensation turning torque value is smaller when the vehicle speed is a first speed than when the vehicle speed is a second speed faster than the first speed; a first target current determination unit that determines a target current of the first electric motor based upon the first manual torque value and the compensation turning torque value; and a second target current determination unit that determines a target current of the second electric motor based upon the second manual torque value and the compensation turning torque value.

13 Claims, 31 Drawing Sheets

(56) References Cited

U.S. PATENT DOCUMENTS

| | | | | |
|---|---|---|---|---|
| 10,285,881 | B2 * | 5/2019 | Kita | A61G 5/1008 |
| 2018/0271725 | A1 * | 9/2018 | Kita | A61G 5/02 |

FOREIGN PATENT DOCUMENTS

| | | | | |
|---|---|---|---|---|
| JP | 2007-143788 | A | 6/2007 | |
| JP | 2010193939 | A | 9/2010 | |
| JP | 2014-057673 | A | 4/2014 | |
| WO | WO-9852508 | A1 * | 11/1998 | A61G 5/045 |
| WO | 2017/037898 | A1 | 3/2017 | |
| WO | WO-2017037898 | A1 * | 3/2017 | A61G 5/024 |
| WO | 2017/068621 | A1 | 4/2017 | |
| WO | WO-2017068621 | A1 * | 4/2017 | A61G 5/02 |

OTHER PUBLICATIONS

Search Report dated Aug. 6, 2020, for corresponding EP Patent Application No. 17925190.5.
The international Search Report for PCT/JP2017/033324 dated Dec. 19, 2017.

* cited by examiner

FIG.16

| WEIGHT | J VALUE |
|---|---|
| W1～W2 | J1 |
| W2～W3 | J2 |
| W3～W4 | J3 |

FIG.22

| | OUTDOOR INDEX | COASTING SETTING | | ASSIST GAIN |
|---|---|---|---|---|
| OUTDOOR SETTING | LEVEL n | DISTANCE: (LONG) | TIME:(LONG) | GAIN (LARGE) |
| ↕ | LEVEL n−1 | ↕ | ↕ | ↕ |
| | • • • • | | | |
| | LEVEL 3 | | | |
| | LEVEL 2 | | | |
| | LEVEL 1 | | | |
| INDOOR SETTING | LEVEL 0 | DISTANCE: (SHORT) | TIME:(SHORT) | GAIN (SMALL) |

POWER ASSIST WHEELCHAIR, POWER ASSIST UNIT FOR WHEELCHAIR, CONTROL DEVICE FOR POWER ASSIST WHEELCHAIR, CONTROL METHOD FOR POWER ASSIST WHEELCHAIR, PROGRAM, AND TERMINAL

CROSS REFERENCE TO RELATED APPLICATIONS

This application is a National Stage of International Application No. PCT/JP2017/033324 filed on Sep. 14, 2017. The contents of the above document is incorporated herein by reference in its entirety.

TECHNICAL FIELD

The present invention relates to a power assist wheelchair, a power assist unit for a wheelchair, a control device for a power assist wheelchair, a control method for a power assist wheelchair, a program, and a terminal.

BACKGROUND ART

Known is a power assist wheelchair driven by combining the power of an occupant rowing a hand rim by hand and the power of an electric motor.

WO 2017037898 discloses a power assist wheelchair that executes single flow prevention control. Single flow indicates that a traveling direction of a wheelchair deviates in an inclined direction on the ground inclined in a vehicle width direction. In WO 2017037898, in order to prevent the single flow, torque applied to a vehicle body is estimated from a difference in an angular velocity between left and right wheels; an estimated disturbance value in a turning direction is obtained by subtracting a torque difference between left hand and right hand rims and a torque difference between left and right motors from the estimated torque; and an assist value is corrected with the estimated disturbance value.

SUMMARY OF THE INVENTION

Technical Problem

In the power assist wheelchair of the related art, it is found out by research of an inventor of the present disclosure that single flow prevention control is performed in a low-speed region where a vehicle speed is relatively low such as the start of a movement of a vehicle, such that turning performance is easily emphasized. This is thought to be because a part of torque in a turning direction based upon the input to a hand rim and the output of an electric motor is consumed for changing a direction of a caster at the start of the movement of the vehicle, and thus actual turning of the vehicle is easy to deviate from a prediction.

One of the objects of the present disclosure is to suppress turning performance of a vehicle in a low-speed region while executing single flow prevention control.

Solution to Problem (1) A power assist wheelchair proposed in the present disclosure includes: first and second wheels separated from each other in a vehicle width direction; a first electric motor that drives the first wheel; a first encoder that detects rotation of the first wheel; a second electric motor that drives the second wheel; a second encoder that detects rotation of the second wheel; and a control device that controls the first and second electric motors. The control device includes: a vehicle speed calculation unit configured to calculate a vehicle speed; a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor; an actual turning torque calculation unit configured to calculate an actual turning torque value based upon a detection signal of the first encoder and a detection signal of the second encoder; a compensation turning torque calculation unit configured to calculate a compensation turning torque value for compensating for at least a part of the shortage or excess of the actual turning torque value with respect to the predicted turning torque value, wherein the compensation turning torque value is smaller when the vehicle speed is a first speed than when the vehicle speed is a second speed faster than the first speed; a first target current determination unit configured to determine a target current of the first electric motor based upon the first manual torque value and the compensation turning torque value; and a second target current determination unit configured to determine a target current of the second electric motor based upon the second manual torque value and the compensation turning torque value. According to the configuration, it is possible to suppress turning performance of a vehicle in a low-speed region while executing single flow prevention control.

(2) In one example of the power assist wheelchair, the compensation turning torque value may be 0 when the vehicle speed is the first speed. According to the configuration, it is possible not only to disable the single flow prevention control in the low-seed region, but also to suppress the turning performance of the vehicle.

(3) In one example of the power assist wheelchair, the compensation turning torque value may be greater than 0 when the vehicle speed is the first speed. According to the configuration, it is possible to suppress the turning performance of the vehicle while allowing the single flow prevention control to be effective in the low-speed region.

(4) One example of the power assist wheelchair may further include a sensor that detects an inclination of a vehicle body in the vehicle width direction, and the compensation turning torque value may be greater when the inclination detected by the sensor is a first inclination angle than when the inclination detected by the sensor is a second inclination angle smaller than the first inclination angle. According to the configuration, when the inclination is relatively small, it is possible not only to weaken the single flow prevention control, but also to suppress the turning performance of the vehicle.

(5) In one example of the power assist wheelchair, the vehicle speed calculation unit may calculate the vehicle speed based upon the detection signal of the first encoder and the detection signal of the second encoder. According to the configuration, it is possible to calculate the vehicle speed by using the detection signal of the encoder.

(6) One example of the power assist wheelchair may further include: a first torque sensor that detects the first manual torque value acting on the first wheel; and a second torque sensor that detects the second manual torque value acting on the second wheel. According to the configuration, it is possible to directly detect the torque acting on the wheel.

(7) In one example of the power assist wheelchair, a coefficient included in a conversion equation for calculating the actual turning torque value may be changed. According to the configuration, it is possible to improve accuracy of the actual turning torque value by using an appropriate coefficient.

(8) In one example of the power assist wheelchair, the control device may change the coefficient in response to a command from a terminal capable of communicating with the control device. According to the configuration, it is possible to set the coefficient from an external terminal.

(9) One example of the power assist wheelchair may further include a weight sensor that detects a weight of a user sitting on a seat, and the actual turning torque calculation unit may calculate the actual turning torque value based upon the detection signal of the first encoder, the detection signal of the second encoder, and the detected weight. According to the configuration, it is possible to improve the accuracy of the actual turning torque value by using the weight detected by the weight sensor.

(10) In one example of the power assist wheelchair, the control device may further include: a determination unit configured to determine whether or not an action mode of the manual torque acting on the first and second wheels satisfies a predetermined condition; and a change unit configured to change the compensation turning torque value to a predetermined magnitude when the action mode of the manual torque satisfies the predetermined condition. According to the configuration, it is possible to adjust the compensation turning torque value according to the action mode of manual torque.

(11) In one example of the power assist wheelchair, the control device may further include: a determination unit configured to determine a type of a traveling environment; and a change unit configured to change the compensation turning torque value to a predetermined magnitude based upon the determined type of the traveling environment. According to the configuration, it is possible to adjust the compensation turning torque value in response to the traveling environment.

(12) One example of a power assist unit for a wheelchair proposed in the present disclosure includes: first and second wheels separated from each other in a vehicle width direction; a first electric motor that drives the first wheel; a first encoder that detects rotation of the first wheel; a second electric motor that drives the second wheel; a second encoder that detects rotation of the second wheel; and a control device that controls the first and second electric motors. The control device includes: a vehicle speed calculation unit configured to calculate a vehicle speed; a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor; an actual turning torque calculation unit configured to calculate an actual turning torque value based upon a detection signal of the first encoder and a detection signal of the second encoder; a compensation turning torque calculation unit configured to calculate a compensation turning torque value for compensating for at least a part of the shortage or excess of the actual turning torque value with respect to the predicted turning torque value, wherein the compensation turning torque value is smaller when the vehicle speed is a first speed than when the vehicle speed is a second speed faster than the first speed; a first target current determination unit configured to determine a target current of the first electric motor based upon the first manual torque value and the compensation turning torque value; and a second target current determination unit configured to determine a target current of the second electric motor based upon the second manual torque value and the compensation turning torque value. According to the configuration, it is possible to suppress the turning performance of the vehicle in the low-speed region while executing the single flow prevention control.

(13) One example of a control device for a power assist wheelchair proposed in the present disclosure including first and second wheels separated from each other in a vehicle width direction, a first electric motor that drives the first wheel, a first encoder that detects rotation of the first wheel, a second electric motor that drives the second wheel, and a second encoder that detects rotation of the second wheel, the device includes: a vehicle speed calculation unit configured to calculate a vehicle speed; a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor; an actual turning torque calculation unit configured to calculate an actual turning torque value based upon a detection signal of the first encoder and a detection signal of the second encoder; a compensation turning torque calculation unit configured to calculate a compensation turning torque value for compensating for at least a part of the shortage or excess of the actual turning torque value with respect to the predicted turning torque value, wherein the compensation turning torque value is smaller when the vehicle speed is a first speed than when the vehicle speed is a second speed faster than the first speed; a first target current determination unit configured to determine a target current of the first electric motor based upon the first manual torque value and the compensation turning torque value; and a second target current determination unit configured to determine a target current of the second electric motor based upon the second manual torque value and the compensation turning torque value. According to the configuration, it is possible to suppress the turning performance of the vehicle in the low-speed region while executing the single flow prevention control.

(14) One example of a control method for a power assist wheelchair proposed in the present disclosure including first and second wheels separated from each other in a vehicle width direction, a first electric motor that drives the first wheel, a first encoder that detects rotation of the first wheel, a second electric motor that drives the second wheel, and a second encoder that detects rotation of the second wheel, the method includes: a vehicle speed calculation step of calculating a vehicle speed; a predicted turning torque calculation step of calculating a predicted turning torque value based upon a first manual torque value acting on the first wheel, a first motor torque value outputted by the first electric motor, a second manual torque value acting on the second wheel, and a second motor torque value outputted by the second electric motor; an actual turning torque calculation step of calculating an actual turning torque value based upon a detection signal of the first encoder and a detection signal of the second encoder; a compensation turning torque calculation step of calculating a compensation turning torque value for compensating for at least a part of the shortage or excess of the actual turning torque value with respect to the predicted turning torque value, wherein the compensation turning torque value is smaller when the vehicle speed is a first speed than when the vehicle speed is a second speed faster than the first speed; a first target current determination step of determining a target current of the first electric motor based upon the first manual torque value and the compensation turning torque value; and a second target current determination step of determining a target current of the second electric motor based upon the second manual torque value and the compensation turning torque value. According to the configuration, it is possible to suppress the turning performance of the vehicle in the low-speed region while executing the single flow prevention control.

(15) One example of a program proposed in the present disclosure for causing a computer of a control device for a power assist wheelchair including first and second wheels separated from each other in a vehicle width direction, a first electric motor that drives the first wheel, a first encoder that detects rotation of the first wheel, a second electric motor that drives the second wheel, a second encoder that detects rotation of the second wheel, and a control device that controls the first and second electric motors to function as a vehicle speed calculation unit configured to calculate a vehicle speed; a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor; an actual turning torque calculation unit configured to calculate an actual turning torque value based upon a detection signal of the first encoder and a detection signal of the second encoder; a compensation turning torque calculation unit configured to calculate a compensation turning torque value for compensating for at least a part of the shortage or excess of the actual turning torque value with respect to the predicted turning torque value, wherein the compensation turning torque value is smaller when the vehicle speed is a first speed than when the vehicle speed is a second speed faster than the first speed; a first target current determination unit configured to determine a target current of the first electric motor based upon the first manual torque value and the compensation turning torque value; and a second target current determination unit configured to determine a target current of the second electric motor based upon the second manual torque value and the compensation turning torque value. According to the configuration, it is possible to suppress the turning performance of the vehicle in the low-speed region while executing the single flow prevention control.

(16) One example of a terminal proposed in the present disclosure, the terminal capable of communicating with the control device for the power assist wheelchair according to above-described (7) includes: a receiving unit configured to receive a change of the coefficient; and an output unit configured to output a command for changing the coefficient to the control device. According to the configuration, it is possible to improve the accuracy of the actual turning torque value by setting the coefficient from the terminal.

Advantageous Effects of Invention

According to the present invention, it is possible to suppress turning performance of a vehicle in a low-speed region while executing single flow prevention control.

BRIEF DESCRIPTION OF THE DRAWINGS

The present invention is illustrated by way of example and not limited in the figures of the accompanying drawings in which like references indicate similar elements.

FIG. 16 is a diagram illustrating a weight-J value table.

FIG. 22 is a diagram illustrating a relationship between outdoor and indoor evaluation and a control parameter.

DETAILED DESCRIPTION OF THE INVENTION

Hereinafter, embodiments of the present invention will be described with reference to the drawings.

[Overall Structure]

Figure 1:
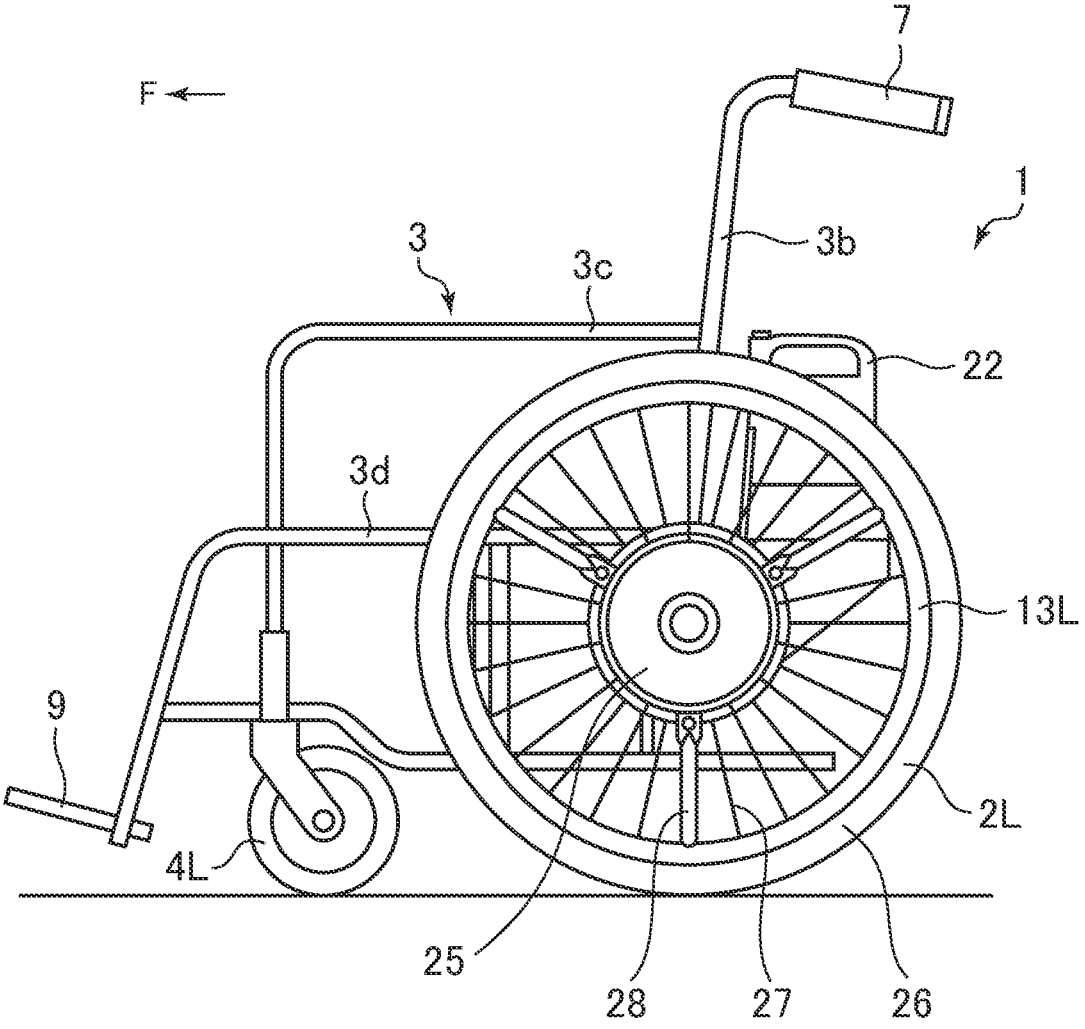
FIG. 1 is a left side view illustrating a power assist wheelchair according to an embodiment.
Figure 2:
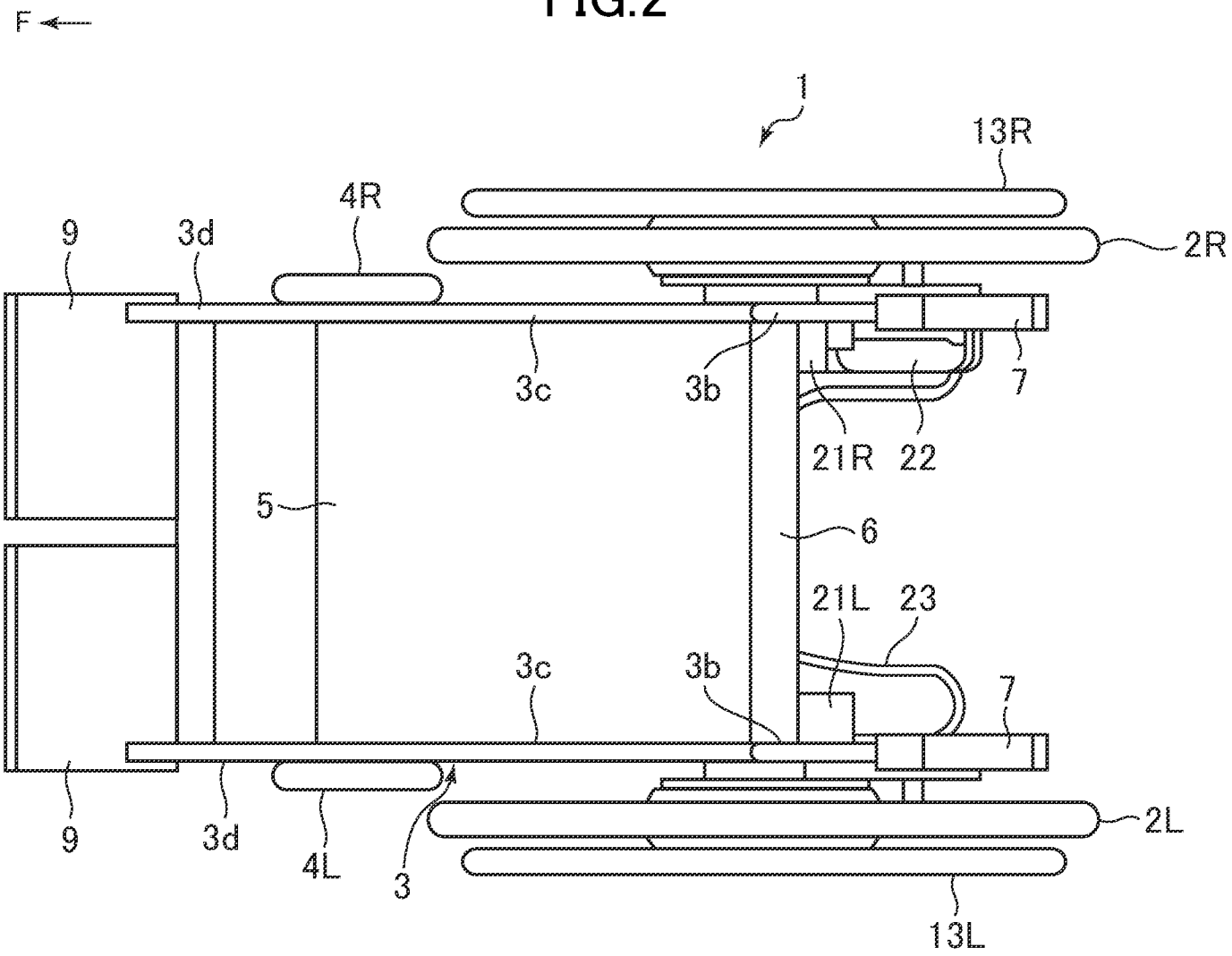
FIG. 2 is a plan view illustrating the power assist wheelchair.

FIGS. 1 and 2 are a left side view and a plan view illustrating a power assist wheelchair 1 (hereinafter also abbreviated as a "wheelchair 1") according to an embodiment. In the specification, a forward direction, a backward direction, an upward direction, a downward direction, a left direction, and a right direction indicate a forward direction, a backward direction, an upward direction, a downward direction, a left direction, and a right direction when viewed from an occupant seated on a seat 5 of the wheelchair 1. The left and right direction is also referred to as a vehicle width direction. Arrows F in FIG. 1 and FIG. 2 represent the forward direction.

The wheelchair 1 includes a vehicle body frame 3 formed of a metal pipe, and the like. A pair of left and right wheels 2L and 2R and a pair of left and right casters 4L and 4R are rotatably supported on the vehicle body frame 3. The vehicle body frame 3 includes a pair of left and right back frames 3*b*, a pair of left and right armrests 3*c*, and a pair of left and right seat frames 3*d*.

The seat frame 3*d* extends in the forward direction from the vicinity of the axles of the wheels 2L and 2R, and the seat 5 for seating an occupant is provided between the seat frames 3*d*. A front part of the seat frame 3*d* is bent in the downward direction, and a footrest 9 is provided at a front lower end of the seat frame 3*d*.

A rear end of the seat frame 3*d* is connected to the back frame 3*b*. The back frame 3*b* extends in the upward direction, and a back support 6 is provided between the back frames 3*b*. An upper part of the back frame 3*b* is bent in the backward direction, and a hand grip 7 for a helper is provided.

The armrest 3*c* is disposed in the upward direction of the seat frame 3*d*. A rear end of the armrest 3*c* is connected to the back frame 3*b*. A front part of the armrest 3*c* is bent in the downward direction, and is connected to the seat frame 3*d*.

The wheels 2L and 2R include a disk-shaped hub 25 including the axle, an outer peripheral part 26 surrounding the hub 25, and a plurality of radially extending spokes 27 interposed between the hub 25 and the outer peripheral part 26. The outer peripheral part 26 includes a rim to which the spoke 27 is connected, and a tire mounted on the rim.

The wheelchair 1 includes hand rims 13L and 13R for manually driving the wheels 2L and 2R, respectively. The hand rims 13L and 13R are annularly formed to have smaller diameters than those of the wheels 2L and 2R, and connected to a plurality of connection pipes 28 radially extending from the hub 25.

The wheelchair 1 also includes electric motors 21L and 21R for respectively driving the wheels 2L and 2R. The electric motors 21L and 21R are, for example, a brushless direct current (DC) motor or an alternating current (AC) servo motor, and include encoders 24L and 24R (refer to FIG. 3) for detecting rotation.

Specifically, the left hand rim 13L is disposed on the outside in the vehicle width direction with respect to the left wheel 2L. The occupant of the wheelchair 1 manually drives the left wheel 2L by rotating the left hand rim 13L. The left electric motor 21L is disposed on the inside in the vehicle width direction with respect to the left wheel 2L. The left wheel 2L rotates integrally with the left electric motor 21L. The left electric motor 21L may be coaxially provided with the left wheel 2L, or may be connected thereto via a gear.

In the same manner, the right hand rim 13R is disposed on the outside in the vehicle width direction with respect to the right wheel 2R. The occupant of the wheelchair 1 manually drives the right wheel 2R by rotating the right hand rim 13R. The right electric motor 21R is disposed on the inside in the vehicle width direction with respect to the right wheel 2R. The right wheel 2R rotates integrally with the right electric motor 21R. The right electric motor 21R may be coaxially provided with the right wheel 2R, or may be connected thereto via a gear.

Figure 3:
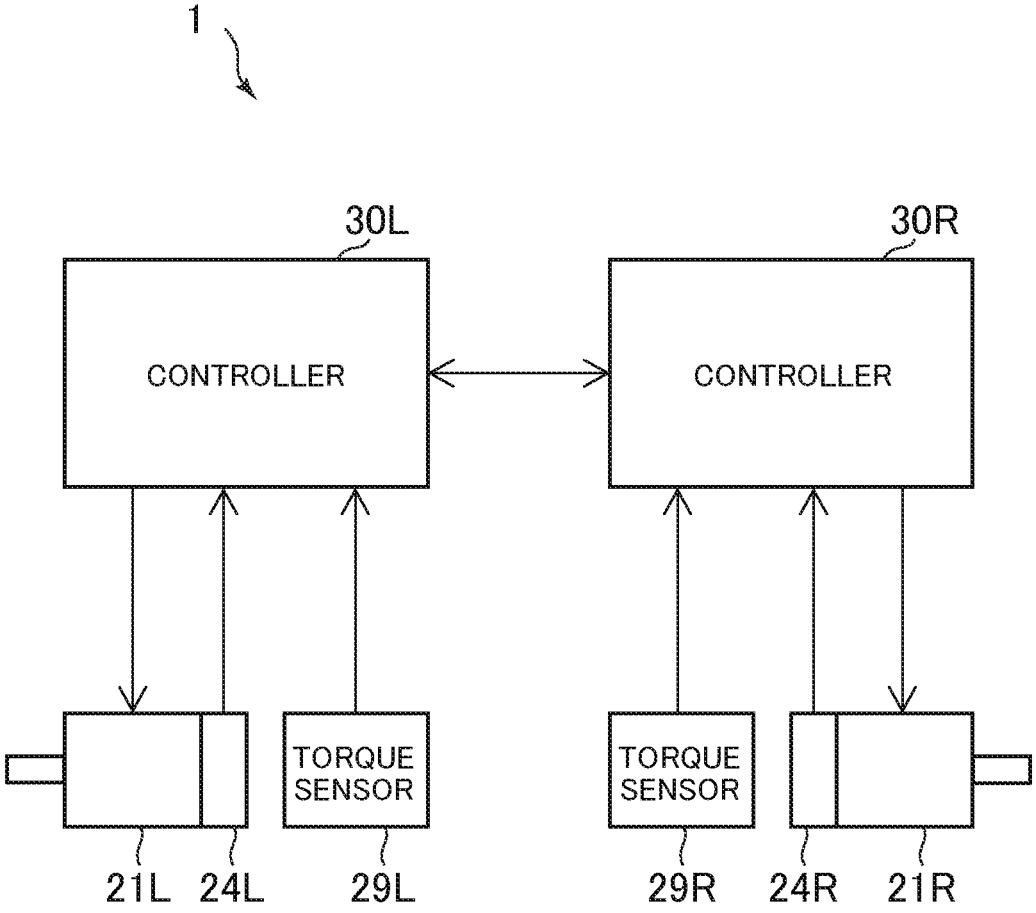
FIG. 3 is a block diagram illustrating a control device for the power assist wheelchair according to the embodiment.

As illustrated in FIG. 3, the wheelchair 1 includes controllers 30L and 30R for respectively controlling the electric motors 21L and 21R. In this example, two controllers 30L and 30R for respectively controlling the electric motors 21L and 21R are provided as a control device according to the embodiment, but this example is not limited thereto, and one controller for controlling the both electric motors 21L and 21R may be provided.

The wheelchair 1 includes torque sensors 29L and 29R. The torque sensors 29L and 29R are provided between, for example, the connection pipe 28 connected to the hand rims 13L and 13R and the hub 25 of the wheels 2L and 2R, and detect torque inputted from the hand rims 13L and 13R to the wheels 2L and 2R. The torque detected by the torque sensors 29L and 29R is treated as manual torque.

Specifically, the left encoder 24L provided in the left electric motor 21L detects rotation of the left electric motor 21L, and outputs a detection signal in response to the rotation to the left controller 30L. The left torque sensor 29L provided in the left wheel 2L detects torque inputted from the left hand rim 13L to the left wheel 2L, and outputs a detection signal in response to the torque to the left controller 30L. The left controller 30L determines a target current of the left electric motor 21L based upon the detection signals from the left encoder 24L and the left torque sensor 29L, and controls a current to be outputted to the left electric motor 21L so that the target current flows. Accordingly, assist torque outputted from the left electric motor 21L is adjusted.

In the same manner, the right encoder 24R provided in the right electric motor 21R detects rotation of the right electric motor 21R, and outputs a detection signal in response to the rotation to the right controller 30R. The right torque sensor 29R provided in the right wheel 2R detects torque inputted from the right hand rim 13R to the right wheel 2R, and outputs a detection signal in response to the torque to the right controller 30R. The right controller 30R determines a target current of the right electric motor 21R based upon the detection signals from the right encoder 24R and the right torque sensor 29R, and controls a current to be outputted to the right electric motor 21R so that the target current flows. Accordingly, assist torque outputted from the right electric motor 21R is adjusted. The controllers 30L and 30R respectively include a microprocessor and a storage unit, and the microprocessor executes processing according to a program stored in the storage unit. The storage unit includes a main storage unit (for example, a RAM) and an auxiliary storage unit (for example, a non-volatile semiconductor memory). The program is supplied to the storage unit via an information storage medium or a communication line.

The controllers 30L and 30R respectively include a motor driver, an analog to digital (AD) converter, a communication interface in addition to the microprocessor and the storage unit. The left controller 30L and the right controller 30R transmit and receive information to and from each other by communication using, for example, a controller area network (CAN).

A battery 22 for supplying electric power to the electric motors 21L and 21R and the controllers 30L and 30R is mounted on the wheelchair 1. In this example, the battery 22 is detachably disposed at the right rear part of the vehicle body frame 3. The wheelchair 1 includes a cable 23 including a feed line and a communication line extending in the left and right direction in the rear direction of the back support 6.

In this example, the electric power is directly supplied from the battery 22 to the right electric motor 21R and the right controller 30R, and the electric power is supplied from the battery 22 to the left electric motor 21L and the left controller 30L via the cable 23. The left controller 30L and the right controller 30R transmit and receive the information to and from each other via the communication line included in the cable 23.

The wheelchair 1 includes a power assist unit 10 for the wheelchair (hereinafter also abbreviated as a "unit 10") according to the embodiment attachable to and detachable from the vehicle body frame 3. The unit 10 includes the wheels 2L and 2R, the hand rims 13L and 13R, the electric motors 21L and 21R, the encoders 24L and 24R, and the controllers 30L and 30R. The unit 10 also includes the battery 22 and the cable 23.

The unit 10 can also be attached to and detached from a vehicle body frame different from the vehicle body frame 3. For example, it is possible to change a general wheelchair into the power assist wheelchair 1 by removing the wheels from the vehicle body frame of the general wheelchair and by mounting the unit 10 on the vehicle body frame thereof.

[Functional Block]

Figure 4:
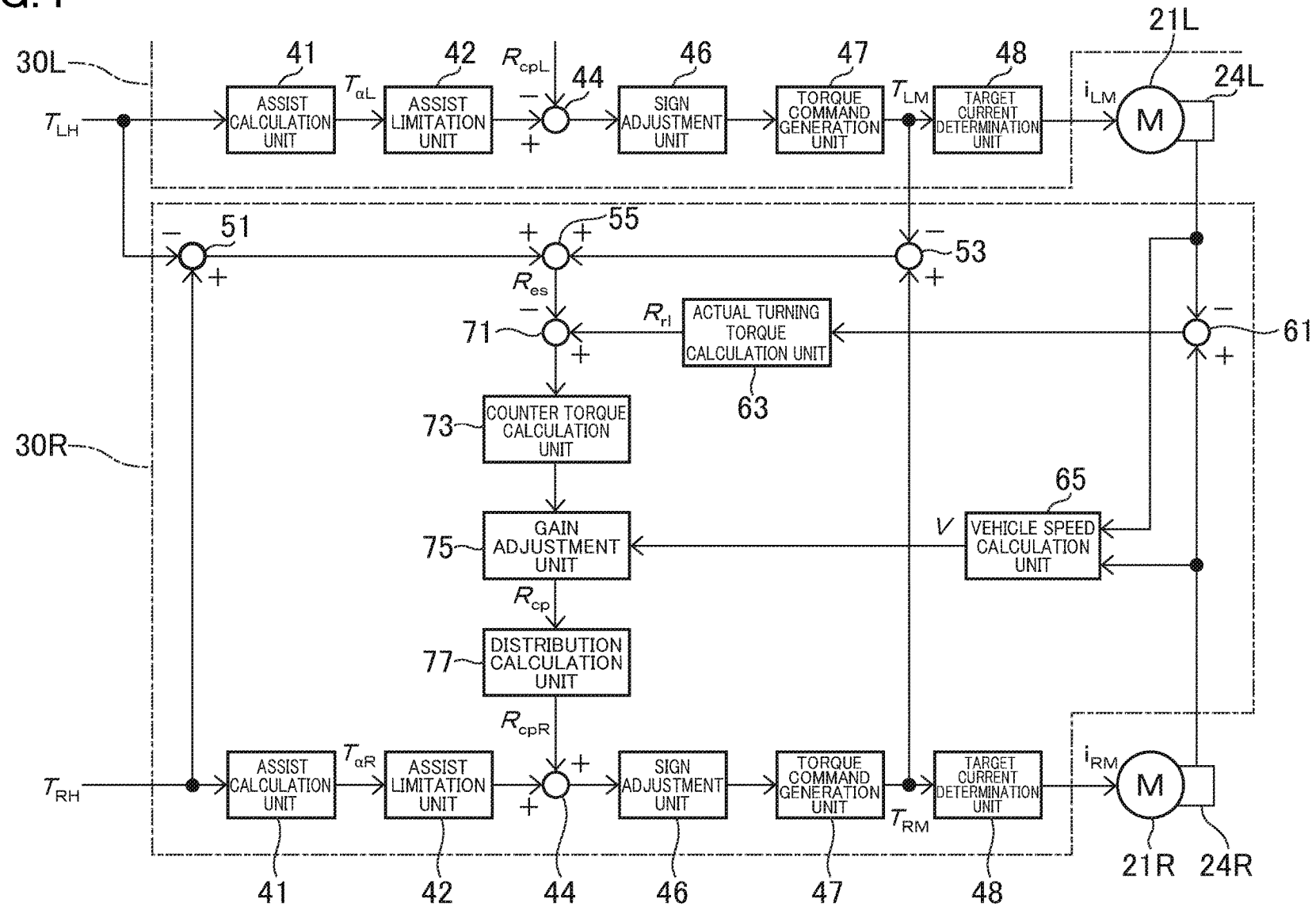
FIG. 4 is a block diagram illustrating a functional configuration of the control device.

FIG. 4 is a block diagram illustrating a functional configuration of the controllers 30L and 30R. Each functional block is implemented by executing processing according to the program stored in the storage unit by the microprocessor included in the controllers 30L and 30R. In the same diagram, the functional configuration of the right controller 30R is mainly illustrated, and the left controller 30L also has the same functional configuration. Hereinafter, the functional configuration of the right controller 30R will be described, and a detailed description of the left controller 30L will be omitted.

The right controller 30R includes an assist calculation unit 41, an assist limitation unit 42, an addition unit 44, a sign adjustment unit 46, a torque command generation unit 47, and a target current determination unit 48 as a block group for determining a target current $i_{RM}$ of the right electric motor 21R based upon a manual torque value $T_{RH}$ of the right wheel 2R.

The manual torque value $T_{RH}$ is, for example, a value of torque inputted from the right hand rim 13R to the right wheel 2R detected by the right torque sensor 29R. The manual torque is torque inputted from a person, and for example, torque inputted to the wheels 2L and 2R by rotating the hand rims 13L and 13R by the occupant of the wheelchair 1.

The torque sensors 29L and 29R are not essential, and for example, it is possible to estimate the manual torque value by subtracting a motor torque value calculated from the output current of the electric motors 21L and 21R from a total torque value calculated from the detection signals of the encoders 24L and 24R. In this case, for example, the torque inputted to the wheels 2L and 2R by pressing the hand grip 7 by a helper, by kicking the floor by the occupant, and by directly rotating the wheel 2 by the occupant can also be obtained as the manual torque value.

Figure 5:
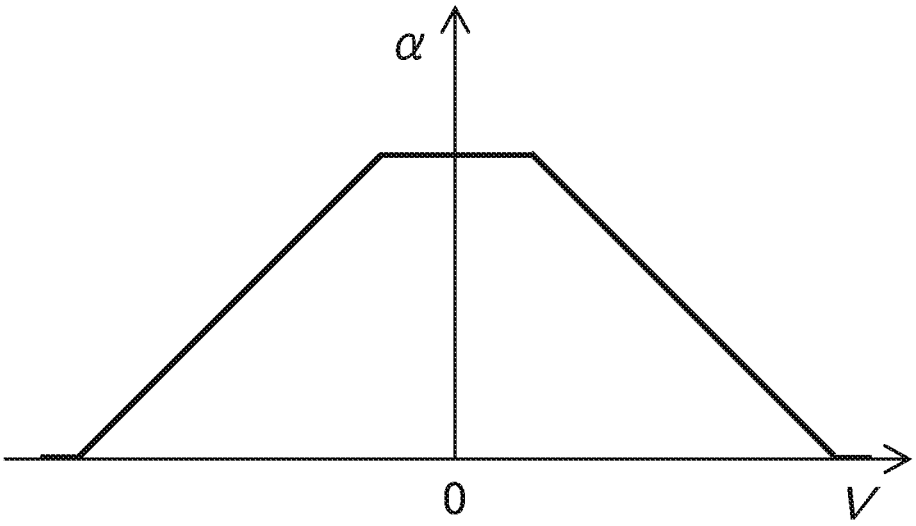
FIG. 5 is a diagram illustrating a relationship between a vehicle speed and an assist ratio.

The assist calculation unit 41 calculates an assist torque value $T_{\alpha R}$ based upon the manual torque value $T_{RH}$ from the right torque sensor 29R and outputs the calculated assist torque value $T_{\alpha R}$ to the assist limitation unit 42. The assist torque value $T_{\alpha R}$ is calculated by, for example, multiplying the manual torque value $T_{RH}$ by a predetermined assist ratio $\alpha$. The assist ratio $\alpha$ is set so that the assist ratio $\alpha$ decreases as a vehicle speed V increases, for example, as illustrated in FIG. 5. The vehicle speed V is acquired from, for example, a vehicle speed calculation unit 65 which will be described later. For example, the assist calculation unit 41 acquires the assist ratio $\alpha$ corresponding to the vehicle speed V from a vehicle speed-assist ratio map stored in the storage unit.

Without being limited thereto, the assist calculation unit 41 may calculate the assist torque value $T_{\alpha R}$ based upon the manual torque value $T_{RH}$ from the right torque sensor 29R and a manual torque value $T_{LH}$ from the left controller 30L. For example, it may be configured that a straight component is extracted by adding the manual torque values $T_{RH}$ and $T_{LH}$; a turning component is extracted by subtracting the other from one of the manual torque values $T_{RH}$ and $T_{LH}$; the straight component is multiplied by an assist ratio for straight travel; and the turning component is multiplied by an assist ratio for turning.

The assist limitation unit 42 determines whether or not the assist torque value $T_{\alpha R}$ from the assist calculation unit 41 exceeds a predetermined upper limit value, outputs the assist torque value $T_{\alpha R}$ as it is to the addition unit 44 when the assist torque value $T_{\alpha R}$ does not exceed the upper limit value, and outputs the upper limit value as the assist torque value $T_{\alpha R}$ to the addition unit 44 when the assist torque value $T_{\alpha R}$ exceeds the upper limit value. The upper limit value is set, for example, in consideration of the limit output of the right electric motor 21R.

The addition unit 44 adds a right wheel component $R_{cpR}$ (details will be described later) of a counter torque value $R_{cp}$ to the assist torque value $T_{\alpha R}$ from the assist limitation unit 42. The assist torque value $T_{\alpha R}$ to which the right wheel component $R_{cpR}$ is added is outputted to the torque command generation unit 47 after a sign is adjusted by the sign adjustment unit 46. The sign adjustment unit 46 is provided in consideration that the other wheel 2 rotates in a reverse direction when one wheel 2 rotates in a normal direction.

The torque command generation unit 47 calculates a torque command value $T_{RM}$ based upon the assist torque value $T_{\alpha R}$ to which the right wheel component $R_{cpR}$ from the sign adjustment unit 46 is added, and then outputs the calculated torque command value $T_{RM}$ to the target current determination unit 48 and a subtraction unit 53 which will be described later. For the calculation of the torque command value $T_{RM}$, for example, a control parameter such as a magnitude of a gain and a time constant of attenuation is used.

The target current determination unit 48 determines the target current $i_{RM}$ of the right electric motor 21R based upon the torque command value $T_{RM}$ from the torque command generation unit 47. The target current determination unit 48 determines the target current $i_{RM}$ of the right electric motor 21R by, for example, dividing the torque command value $T_{RM}$ by a motor torque constant kt. A motor driver, which is not illustrated, included in the right controller 30R controls a current outputted to the right electric motor 21R so that the target current $i_{RM}$ flows.

[Single Flow Prevention Control]

The controllers 30L and 30R execute single flow prevention control which will be hereinafter described. A single flow indicates that a traveling direction of the wheelchair 1 deviates in an inclined direction on the ground inclined in the vehicle width direction.

Figure 6:
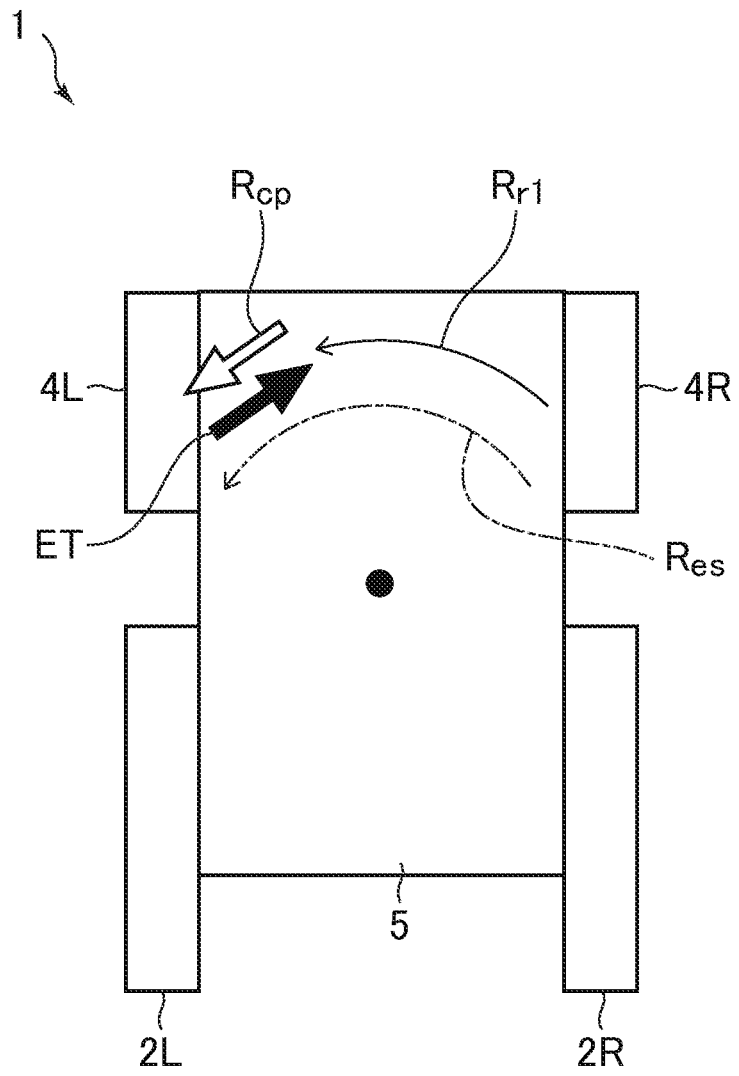
FIG. 6 is a diagram illustrating a relationship between predicted turning torque, actual turning torque, external torque, and counter torque.

As illustrated in FIG. 6, the single flow prevention control is control performed in such a manner that with respect to a turning direction (a yaw direction) of the vehicle body, a difference between predicted turning torque $R_{es}$ calculated based upon the manual torque inputted to the wheels 2L and 2R and the motor torque outputted by the electric motors 21L and 21R, and actual turning torque $R_{rl}$ calculated based upon the detection signals of the encoders 24L and 24R is calculated, external torque ET applied to the vehicle body other than the manual torque and the motor torque is estimated, and the counter torque (compensation turning torque) $R_{cp}$ for offsetting the external torque ET is generated.

The predicted turning torque $R_{es}$ is torque in the turning direction predicted to be generated based upon the manual torque inputted to the wheels 2L and 2R and the motor torque outputted by the electric motors 21L and 21R. The actual turning torque $R_{rl}$ is torque in the turning direction actually generated based upon the detection signals of the encoders 24L and 24R that detect the rotation of the wheels 2L and 2R.

The difference between the predicted turning torque $R_{es}$ and the actual turning torque $R_{rl}$ is estimated as the external torque ET. The external torque ET acts in the inclined direction, for example, when the wheelchair 1 is on inclined ground, which becomes a factor causing the single flow. That is, the external torque ET based upon the inclination acts on the wheelchair 1, such that the traveling direction of the wheelchair 1 deviates from a direction intended by the occupant.

The counter torque $R_{cp}$ is torque in the turning direction generated in a direction opposite to the external torque ET. By generating the counter torque $R_{cp}$, the external torque ET is offset and thus the single flow is suppressed. That is, for example, even though the wheelchair 1 is on inclined ground, since the counter torque $R_{cp}$ acts in a direction opposite to the inclined direction, the traveling direction of the wheelchair 1 hardly deviates in the inclined direction. The controllers 30L and 30R drive the electric motors 21L and 21R so that the counter torque $R_{cp}$ is included in the motor torque outputted by the electric motors 21L and 21R.

Specifically, as illustrated in FIG. 6, when the actual turning torque $R_{rl}$ is insufficient with respect to the predicted turning torque $R_{es}$, since it is estimated that the external torque ET acts in a direction opposite to the predicted turning torque $R_{es}$, the counter torque $R_{cp}$ is generated in the same direction as the predicted turning torque $R_{es}$. In other words, the shortage of the actual turning torque $R_{rl}$ with respect to the predicted turning torque $R_{es}$ is compensated by the counter torque $R_{cp}$.

On the contrary, when the actual turning torque $R_{rl}$ is excessive with respect to the predicted turning torque $R_{es}$, since it is estimated that the external torque ET acts in the same direction as the predicted turning torque $R_{es}$, the counter torque $R_{cp}$ is generated in the direction opposite to the predicted turning torque $R_{es}$. In other words, the excess of the actual turning torque $R_{rl}$ with respect to the predicted turning torque $R_{es}$ is compensated by the counter torque $R_{cp}$.

Meanwhile, it is found out by research of an inventor of this application that the single flow prevention control is performed in a low-speed region where the vehicle speed is relatively low such as the start of movement of the vehicle, such that turning performance is easily emphasized. For example, even when the wheelchair 1 is on a flat ground where there is no inclination and it is originally not required to perform the single flow prevention control, the single flow prevention control is performed in the low-speed region such as the start of movement, and thus the turning performance may be emphasized. It is considered that this problem occurs due to the following reasons.

Figure 7:
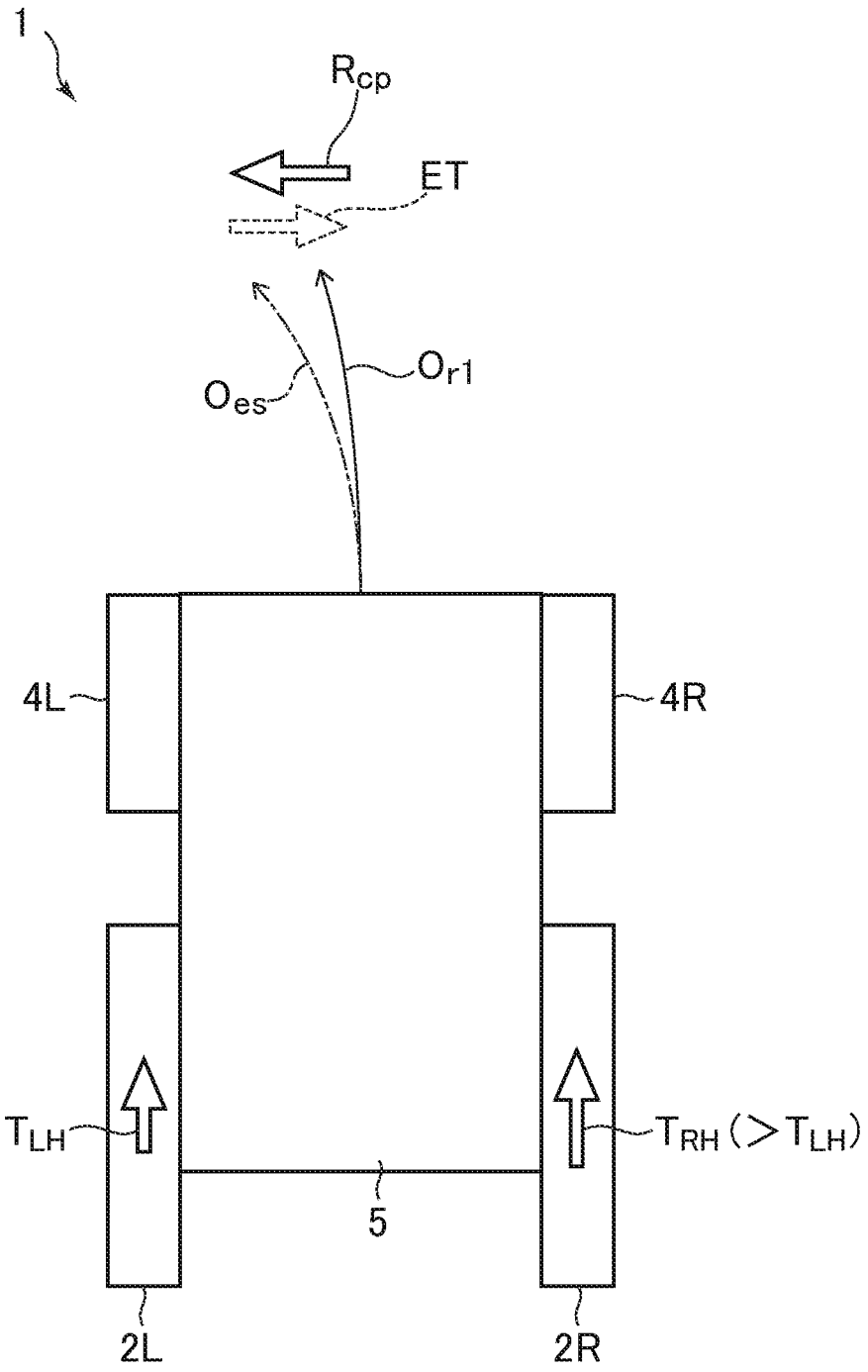
FIG. 7 is a diagram illustrating motion at the start of movement of a wheelchair.

FIG. 7 is a diagram illustrating motion at the start of the movement of the wheelchair 1. First, the motion when the wheelchair 1 tries to travel straight from a state where the wheelchair 1 stops on the flat ground where there is no inclination, will be considered. The left and right manual torque $T_{LH}$ and $T_{RH}$ inputted from the hand rims 13L and 13R to the wheels 2L and 2R are not necessarily equal to each other, and a torque difference therebetween may occur. In this case, the wheelchair 1 starts to move while turning in a direction that deviates from a straight direction to the left and right instead of moving in the straight direction. An example of FIG. 7 shows a case in which the right manual torque $T_{RH}$ is slightly larger than the left manual torque $T_{LH}$, and the wheelchair 1 starts to move while turning in a direction that slightly deviates to the left from the straight direction.

At this time, an actual trajectory $O_{rl}$ of the wheelchair 1 is less curved than a trajectory $O_{es}$ predicted from the manual torque $T_{LH}$ and $T_{RH}$ inputted to the wheels 2L and 2R and the motor torque outputted in response thereto. This is thought to be because a part of the torque is consumed to align the directions of the casters 4L and 4R with the traveling direction in the low-speed region such as the start of movement.

That is, this is the same as the case in which the actual turning torque $R_{rl}$ is insufficient with respect to the predicted turning torque $R_{es}$ as illustrated in FIG. 6. Therefore, the controllers 30L and 30R executing the single flow prevention control estimate that the external torque ET in the direction opposite to the turning direction is applied to the wheelchair 1, and generate the counter torque $R_{cp}$ in the turning direction. The example of FIG. 7 shows a case in which it is estimated that the external torque ET in the right direction is applied to the wheelchair 1 that starts to move while turning in the direction that slightly deviates to the left from the straight direction, and the counter torque $R_{cp}$ in the left direction is generated.

As a result of generating the counter torque $R_{cp}$ in the turning direction in this manner, the wheelchair 1 is easy to move in a curved direction. The above description is thought to be the reason why the turning performance is easily emphasized in the low-speed region when the single flow prevention control is executed.

On the other hand, in a high-speed region where the vehicle speed is relatively high, the problem that the turning performance is easily emphasized hardly occurs. This is thought to be because in the high-speed region, the directions of the casters 4L and 4R are aligned in advance in the traveling direction, and thus the torque is not consumed as much as the low-speed region for changing the directions of the casters 4L and 4R. As illustrated in FIG. 5, it is also considered that since it is common that the assist ratio $\alpha$ is generally set to be lower in the high-speed region than in the low-speed region, the motor torque outputted by the electric motors 21L and 21R is smaller in the high-speed region than in the low-speed region, and thus the torque difference between the wheels 2L and 2R is reduced. In consideration of the motion of the wheelchair 1, it is also considered that on the assumption that it is harder for the wheelchair 1 to curve in the high-speed region than in the low-speed region, that is, a centripetal force of the turning motion is the same, a turning radius is larger in the high-speed region than in the low-speed region and thus the wheelchair 1 approaches linear motion.

In order to solve the problem that the turning performance is easily emphasized in the low-speed region when executing the single flow prevention control described above, in the embodiment, the counter torque $R_{cp}$ generated by the single flow prevention control is outputted so that a value when the vehicle speed is a first speed is smaller than a value when the vehicle speed is a second speed faster than the first speed. That is, the counter torque $R_{cp}$ is outputted so that a value when the vehicle speed is relatively low is smaller than a value when the vehicle speed is relatively high. Here, a fast vehicle speed indicates that an absolute value of the vehicle speed is great.

Hereinafter, referring back to the description of FIG. 4, a configuration for realizing the single flow prevention control according to the embodiment will be described.

The right controller 30R includes a subtraction unit 51, the subtraction unit 53, and an addition unit 55 as a block group (an example of a predicted turning torque calculation unit) that calculates a predicted turning torque value $R_{es}$. This block group calculates the predicted turning torque value $R_{es}$ based upon the manual torque value $T_{RH}$ of the right wheel 2R, the manual torque value $T_{LH}$ of the left wheel 2L, the torque command value $T_{RM}$ of the right electric motor 21R, and a torque command value $T_{LM}$ of the left electric motor 21L.

The subtraction unit 51 calculates a predicted turning torque value related to the manual torque by calculating a difference between the manual torque value $T_{RH}$ of the right wheel 2R and the manual torque value $T_{LH}$ of the left wheel 2L. On the other hand, the subtraction unit 53 calculates a predicted turning torque value related to the motor torque by calculating a difference between the torque command value $T_{RH}$ of the right wheel 2R and the torque command value $T_{LM}$ of the left electric motor 21L. The addition unit 55 adds the predicted turning torque value related to the manual torque from the subtraction unit 51 and the predicted turning torque value related to the motor torque from the subtraction unit 53, thereby calculating the overall predicted turning torque value $R_{es}$ and outputting the calculated overall predicted turning torque value $R_{es}$ to a subtraction unit 71 which will be described later.

The right controller 30R includes a subtraction unit 61 and an actual turning torque calculation unit 63 as a block group (an example of an actual turning torque calculation unit) that calculates an actual turning torque value $R_{rl}$. This block group calculates the actual turning torque value $R_{rl}$ based upon the detection signal of the right encoder 24R and the detection signal of the left encoder 24L.

The subtraction unit 61 calculates a difference between a rotational speed of the right wheel 2R based upon the detection signal from the right encoder 24R and a rotational speed of the left wheel 2L based upon the detection signal from the left encoder 24L, thereby calculating the rotational speed difference between the wheels 2L and 2R.

The actual turning torque calculation unit 63 calculates the actual turning torque value $R_{rl}$ based upon the rotational speed difference between the wheels 2L and 2R from the subtraction unit 61, and outputs the calculated actual turning torque value $R_{rl}$ to the subtraction unit 71 which will be described later. Specifically, the actual turning torque calculation unit 63 converts the rotational speed difference between the wheels 2L and 2R into the actual turning torque value $R_{rl}$ by using, for example, an equation of motion in the turning direction "$J \cdot d\omega/dt = T - D\omega$". Here, w is the rotational speed difference between the wheels 2L and 2R, J is the moment of inertia, D is a viscosity coefficient, and T is the actual turning torque value $R_{rl}$.

The right controller 30R includes the vehicle speed calculation unit 65 that calculates the vehicle speed of the wheelchair 1. The vehicle speed calculation unit 65 calculates the vehicle speed based upon the detection signal of the right encoder 24R and the detection signal of the left encoder 24L, and outputs the calculated vehicle speed to a gain adjustment unit 75 which will be described later. The vehicle speed calculation unit 65 calculates, for example, an average value of the rotational speed of the right wheel 2R based upon the detection signal from the right encoder 24R and the rotational speed of the left wheel 2L based upon the detection signal from the left encoder 24L, and then calculates the vehicle speed from the average value.

Without being limited thereto, the vehicle speed calculation unit 65 may calculate the vehicle speed based upon the detection signal of one of the encoders 24L and 24R, and may separately provide an acceleration sensor and calculate the vehicle speed based upon a detection signal of the acceleration sensor.

The right controller 30R includes the subtraction unit 71, a counter torque calculation unit 73, and the gain adjustment unit 75 as a block group (an example of a compensation turning torque calculation unit) that calculates the counter torque value $R_{cp}$. This block group calculates the counter torque value $R_{cp}$ based upon the predicted turning torque value $R_{es}$ from the addition unit 55 and the actual turning torque value $R_{rl}$ from the actual turning torque calculation unit 63.

The subtraction unit 71 calculates a difference between the predicted turning torque value $R_{es}$ from the addition unit 55 and the actual turning torque value $R_{rl}$ from the actual turning torque calculation unit 63, and outputs the difference therebetween to the counter torque calculation unit 73. The difference therebetween represents the external torque ET acting on the wheelchair 1. In an example illustrated in the drawing, the subtraction unit 71 subtracts the predicted turning torque value $R_{es}$ from the actual turning torque value $R_{rl}$, and the addition unit 44 adds the right wheel component $R_{cpR}$ of the counter torque value $R_{cp}$ to the assist torque value $T_{\alpha R}$.

On the contrary, the subtraction unit 71 may subtract the actual turning torque value $R_{rl}$ from the predicted turning torque value $R_{es}$, and the addition unit 44 may subtract the right wheel component $R_{cpR}$ of the counter torque value $R_{cp}$ from the assist torque value $T_{\alpha R}$.

The counter torque calculation unit 73 calculates a basic counter torque value based upon the difference between the predicted turning torque value $R_{es}$ and the actual turning torque value $R_{rl}$. The basic counter torque value is calculated so as to compensate for at least a part of the shortage or excess of the actual turning torque value $R_{rl}$ with respect to the predicted turning torque value $R_{es}$. The magnitude of the basic counter torque value is, for example, the same as the difference between the predicted turning torque value $R_{es}$ and the actual turning torque value $R_{rl}$, but is not limited thereto and may be larger or smaller than the difference.

The gain adjustment unit 75 calculates the counter torque value $R_{cp}$ by multiplying the basic counter torque value from the counter torque calculation unit 73 by the gain in response to the vehicle speed from the vehicle speed calculation unit 65. The counter torque value $R_{cp}$ is gain-adjusted so that the value when the vehicle speed is the first speed is smaller than the value when the vehicle speed is the second speed faster than the first speed.

The gain adjustment unit 75 performs gain adjustment in response to the vehicle speed by using, for example, a vehicle speed-gain map representing a relationship between the vehicle speed and the gain stored in the storage unit. Specifically, the gain adjustment unit 75 reads out the gain in response to the vehicle speed from the vehicle speed-gain map, and multiplies the read gain by the basic counter torque value. However, without being limited thereto, the gain adjustment unit 75 may perform the gain adjustment in response to the vehicle speed by using, for example, a predetermined mathematical equation.

Figure 8:
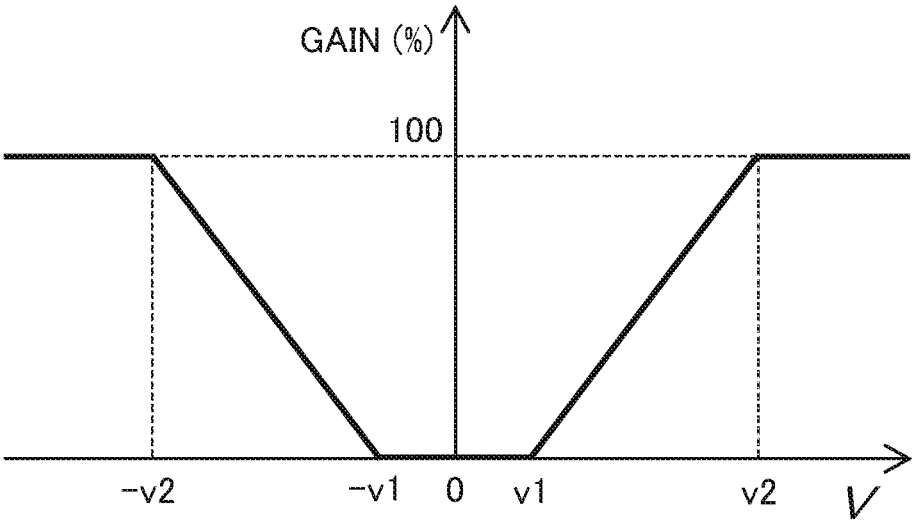
FIG. 8 is a diagram illustrating an example of a relationship between a vehicle speed and a gain.

FIG. 8 is a diagram illustrating an example of the vehicle speed-gain map. A gain G is set so that the value when the vehicle speed V is the first speed is smaller than the value when the vehicle speed V is the second speed faster than the first speed. That is, the gain G is set so that a value when the vehicle speed V is relatively low is smaller than a value when the vehicle speed V is relatively high.

Specifically, the gain G is set to 0 in a range where an absolute value of the vehicle speed V is equal to or lower than v1 (hereinafter referred to as a low-speed region). In a range where the absolute value of the vehicle speed V is equal to or greater than v1 and equal to or lower than v2 (hereinafter, a middle speed region), the gain G gradually increases from 0 to 100% as the absolute value of the vehicle speed V increases. In a range where the absolute value of the vehicle speed V is equal to or greater than v2 (hereinafter, a high-speed region), the gain G is set to 100%. In this example, v1 is, for example, 1 km/h and v2 is, for example, 4 km/h. The gain G when the vehicle speed V is in the low-speed region is smaller than the gain when the vehicle speed V is in the medium speed region or the high-speed region. The gain G when the vehicle speed V is in the middle speed region is smaller than the gain G when the vehicle speed V is in the high-speed region.

Figure 9:
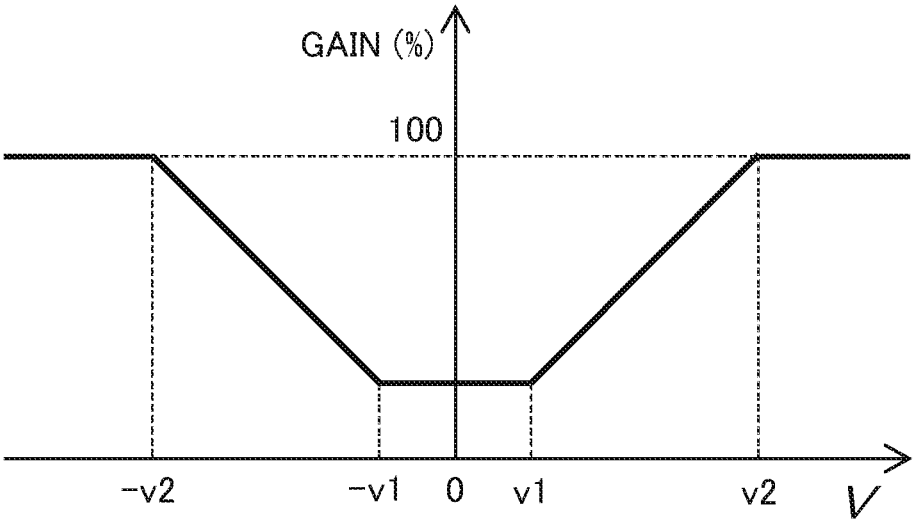
FIG. 9 is a diagram illustrating another example of a relationship between a vehicle speed and a gain.

Without being limited thereto, as illustrated in FIG. 9, the gain G may be greater than 0 in the low-speed region. The gain G in the low-speed region is, for example, desirably equal to or greater than 5%, more desirably equal to or greater than 10%, and is desirably equal to or lower than 50%, more desirably equal to or lower than 40%.

A distribution calculation unit 77 calculates the right wheel component $R_{cpR}$ of the counter torque value $R_{cp}$ based upon the counter torque value $R_{cp}$ whose gain is adjusted by the gain adjustment unit 75, and outputs the calculated right wheel component $R_{cpR}$ to the addition unit 44. The right wheel component $R_{cpR}$ represents torque to be outputted from the right electric motor 21R to the right wheel 2R in order to generate the counter torque. The right wheel component $R_{cpR}$ outputted to the addition unit 44 is included in the torque command value $T_{RM}$ of the right electric motor 21R. In the same manner, even in the left controller 30L, a left wheel component $R_{cpL}$ of the counter torque value $R_{cp}$ is calculated and included in the torque command value $T_{LM}$ of the left electric motor 21L.

For example, when the counter torque in the left direction is generated, a part (for example, half) of the counter torque value $R_{cp}$ is calculated as the right wheel component $R_{cpR}$ and the assist torque value $T_{\alpha R}$ of the right wheel 2R is increased. On the other hand, a remaining part is calculated as the left wheel component $R_{cpL}$ and the assist torque value $T_{\alpha L}$ of the left wheel 2L is decreased. Without being limited thereto, for example, all the counter torque value $R_{cp}$ may be the right wheel component $R_{cpR}$ and the left wheel component $R_{cpL}$ may be 0.

In the example described above, both of the controllers 30L and 30R calculate the predicted turning torque value $R_{es}$, the actual turning torque value $R_{rl}$, and the counter torque value $R_{cp}$, and without being limited thereto, for example, one of the controllers 30L and 30R may be configured to calculate at least a part of the predicted turning torque value $R_{es}$, the actual turning torque value $R_{rl}$, and the counter torque value $R_{cp}$, and to transmit the calculated value to the other one.

Figure 10:
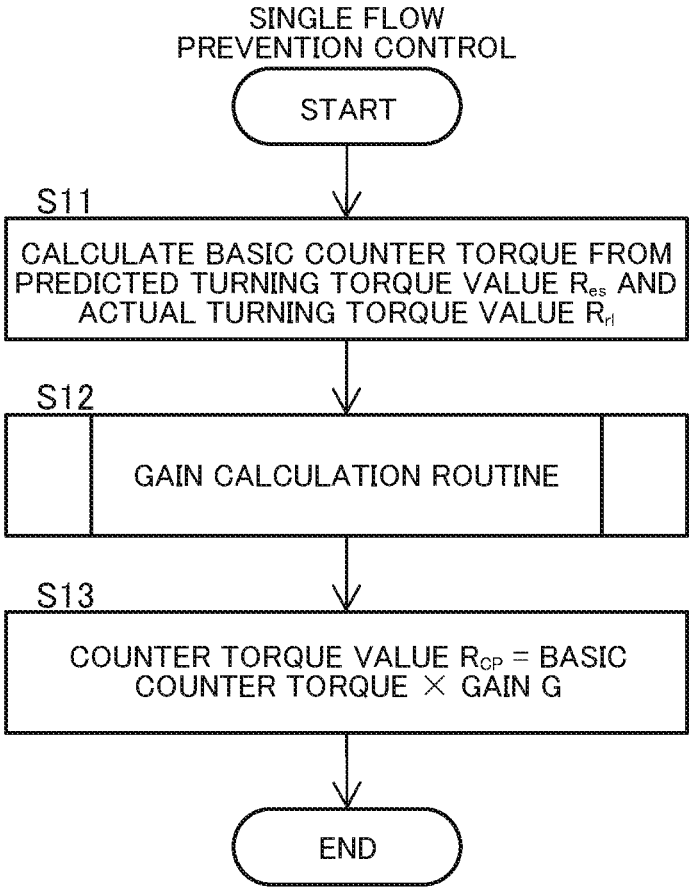
FIG. 10 is a flowchart illustrating a control method for the power assist wheelchair according to the embodiment.
Figure 11:
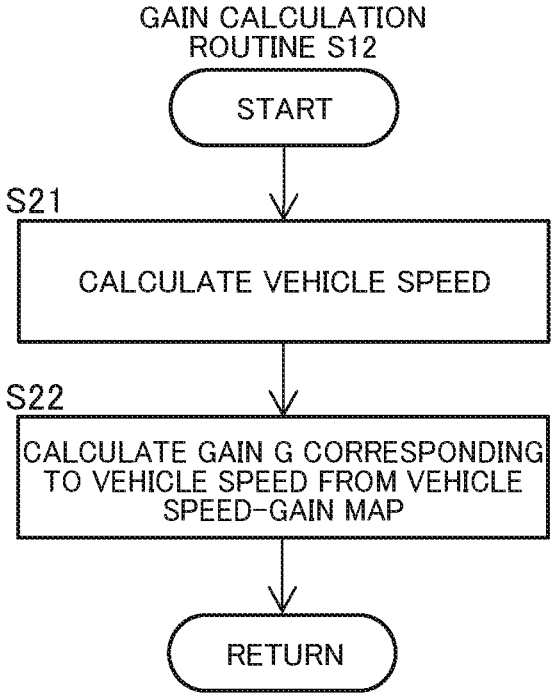
FIG. 11 is a flowchart illustrating a gain calculation routine.

FIGS. 10 and 11 are flowcharts illustrating a control method according to the embodiment. The controllers 30L and 30R implement the single flow prevention control illustrated in the same drawing by executing the processing according to the program related to the embodiment stored in the storage unit by the microprocessor. The single flow prevention control illustrated in the same drawing is executed in each of the controllers 30L and 30R.

First, the controllers 30L and 30R calculate the basic counter torque value from the predicted turning torque value $R_{es}$ and the actual turning torque value $R_{rl}$ (S11). As described above, the predicted turning torque value $R_{es}$ is calculated based upon the manual torque values $T_{LH}$ and $T_{RH}$ representing the manual torque inputted to the wheels 2L and 2R, and the torque command values $T_{LM}$ and $T_{RM}$ representing the motor torque outputted from the electric motors 21L and 21R. The actual turning torque value $R_{rl}$ is calculated based upon the detection signals from the encoders 24L and 24R that detect the rotation of the wheels 2L and 2R. The basic counter torque value is calculated so as to compensate for the shortage or excess of the actual turning torque value $R_{rl}$ with respect to the predicted turning torque value $R_{es}$.

Next, the controllers 30L and 30R execute a gain calculation routine (S12). In the gain calculation routine S12 illustrated in FIG. 11, first, the controllers 30L and 30R calculate the vehicle speed of the wheelchair 1 based upon the detection signals of the encoders 24L and 24R (S21). Next, the controllers 30L and 30R calculate the gain G corresponding to the calculated vehicle speed from the vehicle speed-gain map (S22). As described above, the gain G is set so that the value when the vehicle speed V is the first speed is smaller than the value when the vehicle speed V is the second speed faster than the first speed (refer to FIG. 8 or FIG. 9). When the gain G is calculated, the gain calculation routine S12 is terminated.

Referring back to the description of FIG. 10, the controllers 30L and 30R calculate the counter torque value $R_{cp}$ by multiplying the basic counter torque value by the gain G. Thus, the counter torque value $R_{cp}$ is calculated so that the value when the vehicle speed is the first speed is smaller than the value when the vehicle speed is the second speed faster than the first speed. The counter torque value $R_{cp}$ calculated in this manner is divided into the left wheel component $R_{cpL}$, and the right wheel component $R_{cpR}$ as described above, and is included in the torque command values $T_{LM}$ and $T_{RM}$ of the electric motors 21L and 21R. As a result, the counter torque is generated in the wheelchair 1.

According to the embodiment described above, since the counter torque value $R_{cp}$ is gain-adjusted so that the value when the vehicle speed is the first speed is smaller than the value when the vehicle speed is the second speed faster than the first speed, it is possible to suppress the turning performance of the vehicle in the low-speed region while executing the single flow prevention control.

On the other hand, in the high-speed region where the problem that the turning performance is easily emphasized is hard to occur, an effect of the single flow prevention control can be maximized.

Specifically, as illustrated in FIG. 8, the gain G in the low-speed region where the absolute value of the vehicle speed V is equal to or lower than v1 is set to 0 and the counter torque value $R_{cp}$ is set to 0, whereby it is possible to disable the single flow prevention control in the low-speed region and suppress the turning performance of the vehicle.

As illustrated in FIG. 9, the gain G in the low-speed region where the absolute value of the vehicle speed V is equal to or lower than v1 is set to be greater than 0, and the counter torque value $R_{cp}$ is set to be greater than 0, whereby it is possible to suppress the turning performance of the vehicle while performing the single flow prevention control in the low-speed region.

First Modified Example

Figure 12:
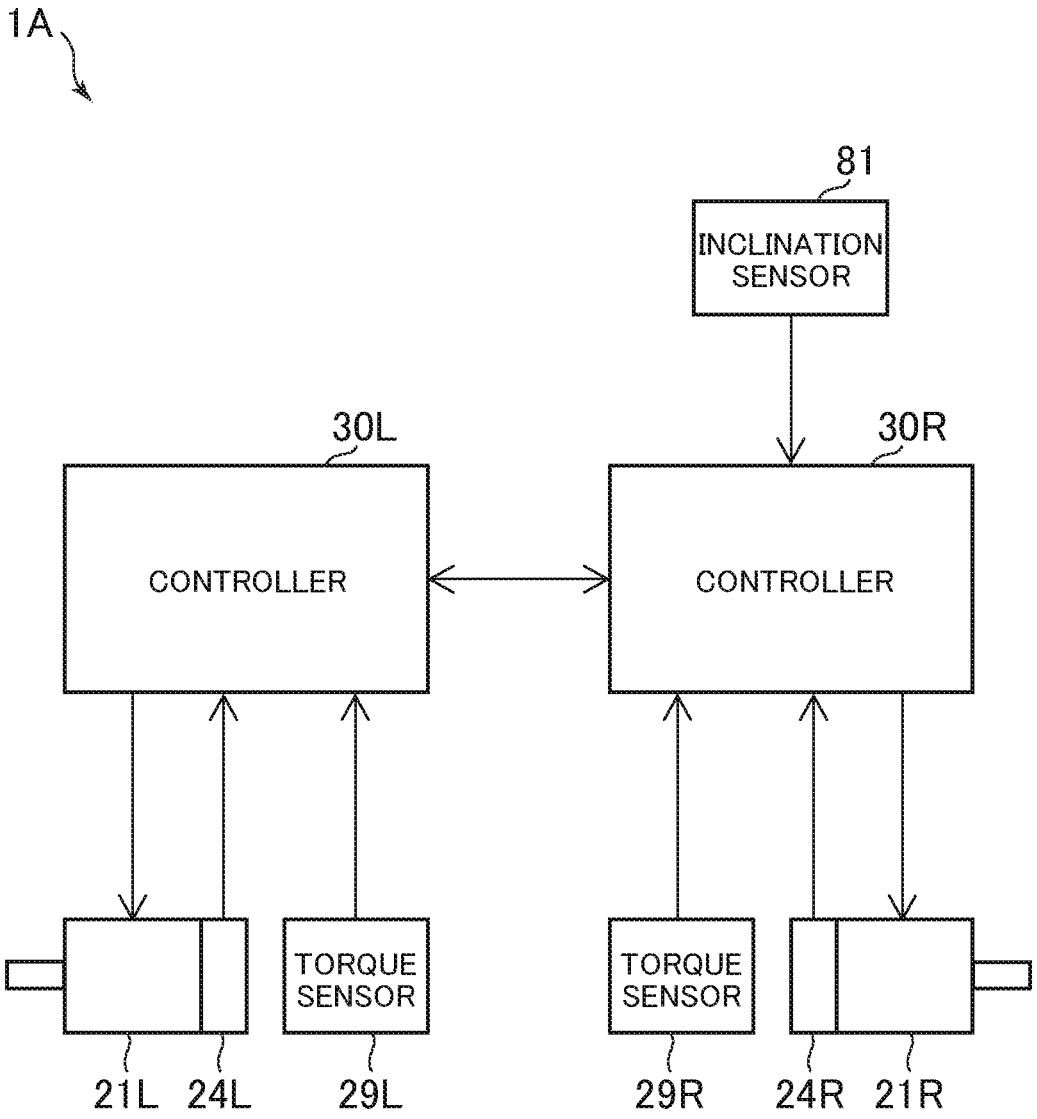
FIG. 12 is a block diagram illustrating a control device for a power assist wheelchair according to a modified example.

FIG. 12 is a block diagram illustrating a wheelchair 1A according to a first modified example. The wheelchair 1A further includes an inclination sensor 81 that detects an inclination of the vehicle body in addition to the configuration of the wheelchair 1 illustrated in FIG. 3. The inclination sensor 81 is connected to, for example, the right controller 30R, and outputs a detection signal in response to the inclination of the vehicle body in the vehicle width direction to the right controller 30R. The right controller 30R acquires a value representing the inclination of the vehicle body in the vehicle width direction based upon the detection signal from the inclination sensor 81, and outputs the acquired value to the left controller 30L. On the contrary, the inclination sensor 81 may be connected to the left controller 30L. The sensor that detects the inclination of the vehicle body is not limited to the inclination sensor 81, but for example, a gyro sensor, or the like, may be applied thereto.

The gain adjustment unit 75 (refer to FIG. 4) included in the controllers 30L and 30R of the wheelchair 1A multiplies the basic counter torque value by the gain in response to the vehicle speed of the wheelchair 1 and the inclination in the vehicle width direction, thereby calculating the counter torque value $R_{cp}$. The counter torque value $R_{cp}$ is gain-adjusted so that a value when the inclination is a first inclination angle is greater than a value when the inclination is a second inclination angle smaller than the first inclination angle. That is, the counter torque value $R_{cp}$ is gain-adjusted so that a value when the inclination is relatively large is greater than a value when the inclination is relatively small. The gain adjustment unit 75 performs the gain adjustment in response to the vehicle speed and the inclination by using, for example, a three-dimensional map representing a relationship between the vehicle speed, the inclination, and the gain stored in the storage unit.

Figure 13:
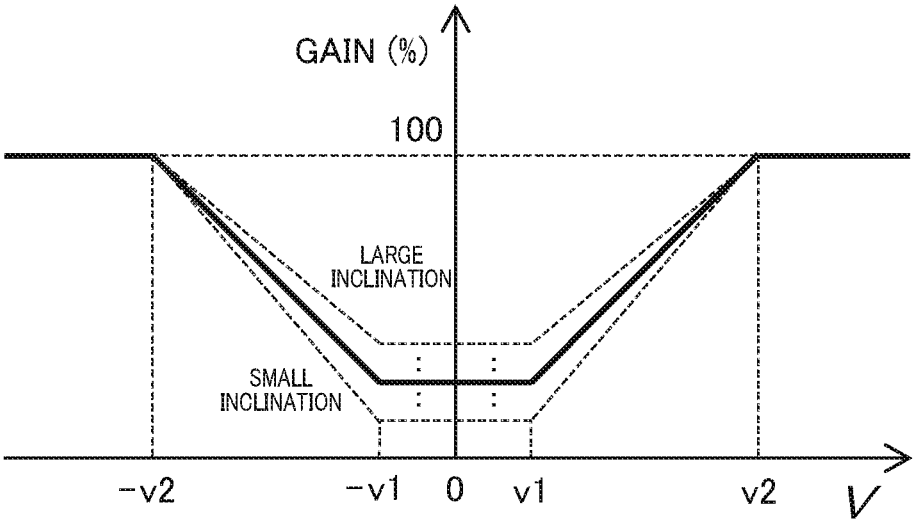
FIG. 13 is a diagram illustrating a relationship between a vehicle speed, an inclination, and a gain.

FIG. 13 is a diagram illustrating an example of the three-dimensional map representing the relationship between the vehicle speed, the inclination, and the gain. In the same diagram, three lines representing the relationship between the vehicle speed and the gain having different inclinations are projected on a vehicle speed-gain plane. The gain G is set so that the value when the inclination is the first inclination angle is greater than the value when the inclination is the second inclination angle smaller than the first inclination angle. That is, the gain G is set so that the value when the inclination is relatively large is greater than the value when the inclination is relatively small.

Specifically, in the low-speed region where the absolute value of the vehicle speed V is equal to or lower than v1, the gain G is set so that the value when the inclination is relatively large is greater than the value when the inclination is relatively small. When the inclination is 0, the gain G may be set to 0. In the same manner, even in the middle speed region where the absolute value of the vehicle speed V is equal to or greater than v1 and equal to or lower than v2, the gain G is set so that the value when the inclination is relatively large is greater than the value when the inclination is relatively small. On the other hand, in the high-speed region where the absolute value of the vehicle speed V is equal to or greater than v2, the gain G remains 100% even though the inclination changes.

According to the modified example described above, when the inclination is relatively small, it is possible to suppress the turning performance of the vehicle by weakening the single flow prevention control. That is, when the inclination in the vehicle width direction is relatively small and the necessity for operating the single flow prevention control is relatively low, it is possible to suppress the turning performance of the vehicle by weakening the single flow prevention control, whereas when the inclination in the vehicle width direction is relatively large and the necessity for operating the single flow prevention control is relatively high, it is possible to suppress the single flow by strengthening the single flow prevention control.

Second Modified Example

Figure 14:
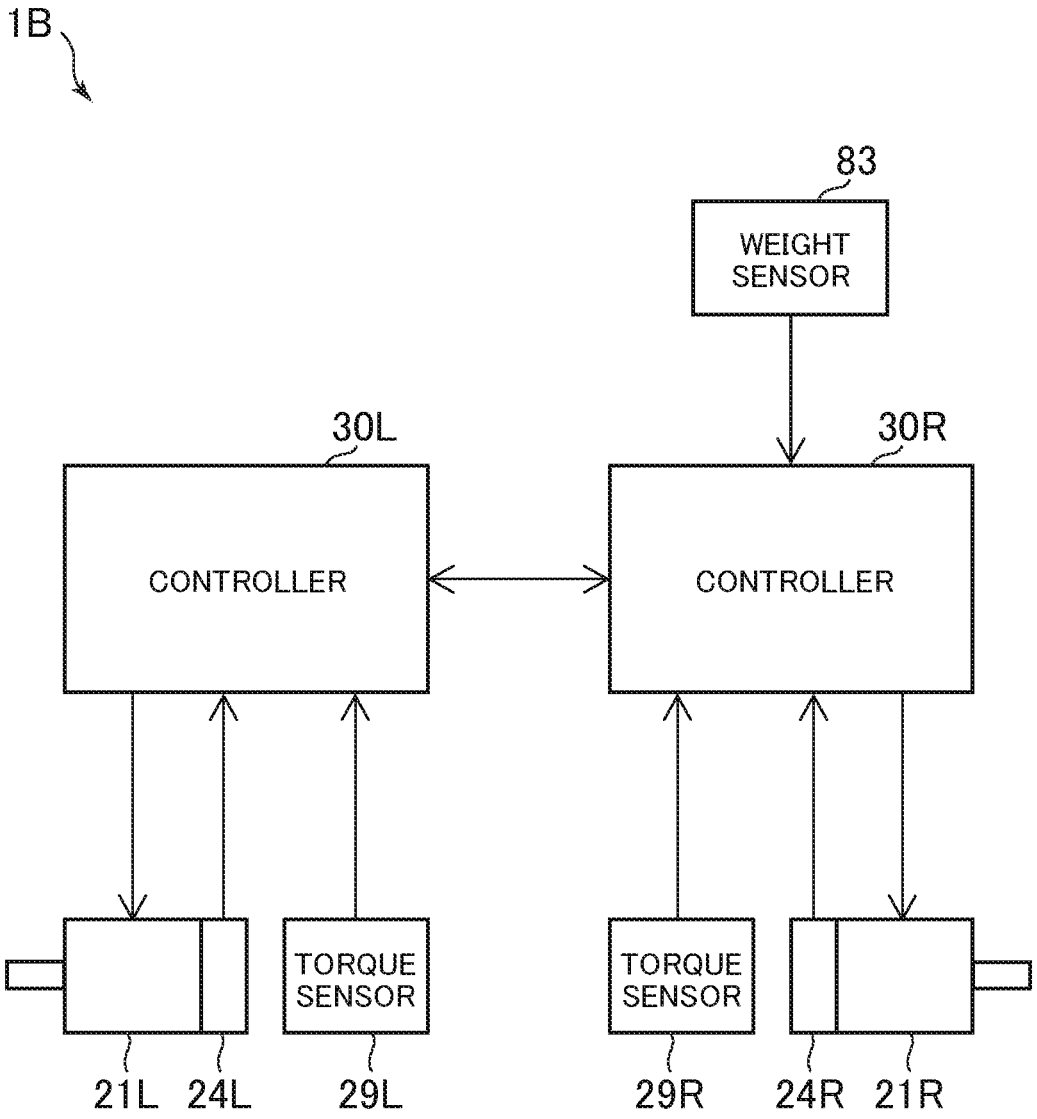
FIG. 14 is a block diagram illustrating a control device for a power assist wheelchair according to a modified example.

FIG. 14 is a block diagram illustrating a wheelchair 1B according to a second modified example. The wheelchair 1B further includes a weight sensor 83 that detects a weight of the occupant seated on the seat 5 in addition to the configuration of the wheelchair 1 illustrated in FIG. 3. The weight sensor 83 is connected to, for example, the right controller 30R, and outputs a detection signal in response to the weight of the occupant to the right controller 30R. The right controller 30R acquires a value representing the weight of the occupant based upon the detection signal from the weight sensor 83 and outputs the acquired value to the left controller 30L. On the contrary, the weight sensor 83 may be connected to the left controller 30L.

Figure 15:
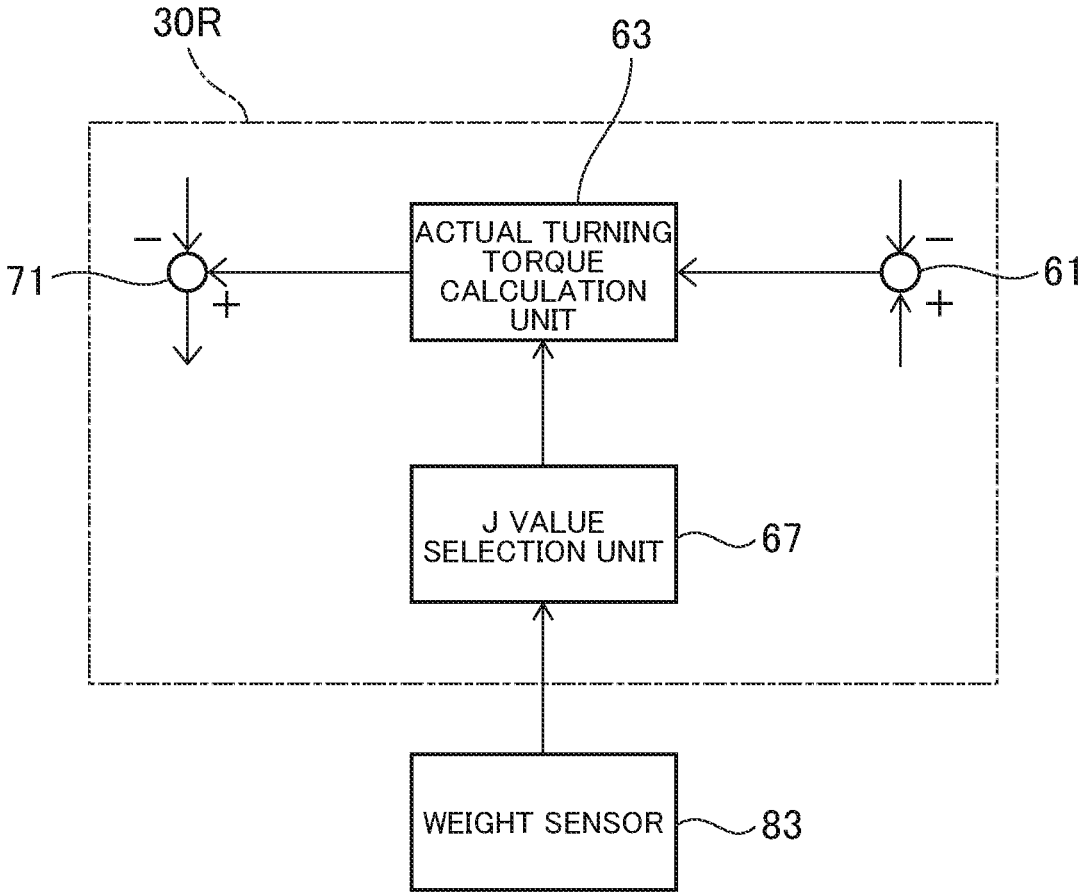
FIG. 15 is a block diagram illustrating a functional configuration of the control device.

FIG. 15 is a block diagram illustrating a functional configuration of the controllers 30L and 30R of the wheelchair 1B. Hereinafter, the functional configuration of the right controller 30R will be described, and the left controller 30L also has the same functional configuration. In the same diagram, the actual turning torque calculation unit 63 and only the blocks therebefore and thereafter are illustrated, and illustration of other blocks are omitted. The right controller 30R further includes a J value selection unit 67 in addition to the functional configuration illustrated in FIG. 4.

As described above, the actual turning torque calculation unit 63 converts the rotational speed difference between the wheels 2L and 2R into the actual turning torque value $R_{rl}$ by using the equation of motion in the turning direction "$J \cdot d\omega/dt = T - D\omega$". A coefficient J included in this conversion equation "$J \cdot d\omega/dt = T - D\omega$" represents the moment of inertia, and when a J value used for the calculation deviates from an actual value, a calculation result of the actual turning torque value $R_{rl}$ may also deviate from the actual value.

Here, in this modified example, the J value selection unit 67 is provided, and the actual turning torque calculation unit 63 can change the J value included in the conversion equation "$J \cdot d\omega/dt = T - D\omega$" for calculating the actual turning torque value $R_{rl}$. Specifically, the J value selection unit 67 selects the J value based upon the weight detected by the weight sensor 83, and the actual turning torque calculation unit 63 calculates the actual turning torque value $R_{rl}$ by using the selected J value.

The moment of inertia is relatively large depending on the weight of the occupant seated on the seat 5. Therefore, in this modified example, the J value is selected in response to the weight of the occupant detected by the weight sensor 83, whereby the J value used for the calculation is prevented from deviating from the actual value.

The J value selection unit 67 refers to, for example, a weight-J value table stored in the storage unit, and can acquire the J value in response to the detected weight, and output the acquired J value to the actual turning torque calculation unit 63. FIG. 16 is a diagram illustrating an example of the weight-J value table. In the weight-J value table, the J value is associated with each weight range.

According to the modified example described above, since the J value included in the conversion equation "$J \cdot d\omega/dt = T - D\omega$" for calculating the actual turning torque value $R_{rl}$ can be changed, it is possible to improve the accuracy of the actual turning torque value $R_{rl}$ by using the appropriate J value. Specifically, the J value is selected based upon the weight of the occupant detected by the weight sensor 83, thereby making it possible to improve the accuracy of the actual turning torque value $R_{rl}$.

Third Modified Example

Figure 17:
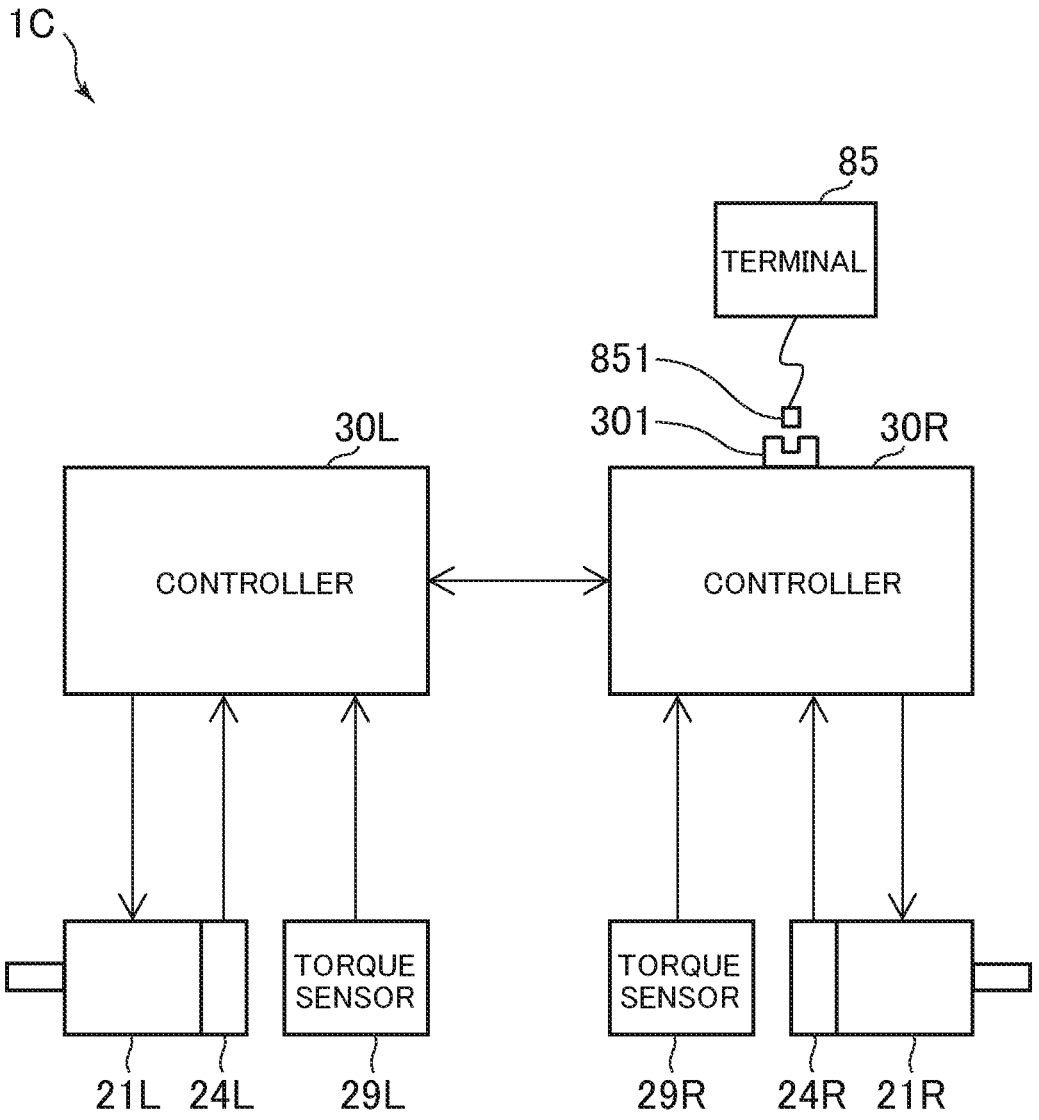
FIG. 17 is a block diagram illustrating a control device for a power assist wheelchair according to a modified example.

FIG. 17 is a block diagram illustrating a wheelchair 1C according to a third modified example. The right controller 30R of the wheelchair 1C is configured to be able to communicate with an external terminal 85. Specifically, the right controller 30R is provided with a connector 301, and a connector 851 provided on a cable extending from the terminal 85 is connected to the connector 301, whereby the right controller 30R and the terminal 85 can communicate with each other. Without being limited thereto, the right controller 30R and the terminal 85 may be able to communicate with each other by wireless communication. The left controller 30L may be configured to be able to communicate with the terminal 85.

The terminal 85 includes an input device such as, for example, a touch panel or a keyboard, receives the input of the J value from a user of the terminal 85 (an example of a receiving unit), and transmits a command for changing the J value together with the received J value to the controllers 30L and 30R (an example of an output unit). When receiving the command from the terminal 85, the controllers 30L and 30R rewrite the J value stored in the storage unit to the received J value. Accordingly, the actual turning torque calculation unit 63 (refer to FIGS. 4 and 15) calculates the actual turning torque value $R_{rl}$ by using the conversion equation "$J \cdot d\omega/dt = T - D\omega$" including the J value newly stored in the storage unit.

Without being limited thereto, for example, the terminal 85 may display a plurality of J values on a display device such as a liquid crystal display panel and may receive the selection of the J value.

The terminal 85 may receive, for example, the input or selection of the weight of the occupant using the wheelchair 1, and may transmit the command for changing the J value together with the received weight to the controllers 30L and 30R. In this case, the controllers 30L and 30R include the J value selection unit 67 which is the same as that of the second modified example, and the J value selection unit 67 selects the J value corresponding to the weight received from the terminal 85, and rewrites the J value stored in the storage unit to the selected J value.

According to the modified example described above, since the J value included in the conversion equation "$J \cdot d\omega/dt = T - D\omega$" for calculating the actual turning torque value $R_{rl}$ can be changed, it is possible to improve the accuracy of the actual turning torque value $R_{rl}$ by using the appropriate J value. Specifically, the J value is set from the external terminal 85, thereby making it possible to improve the accuracy of the actual turning torque value $R_{rl}$.

When the wheelchair 1 is shipped from a factory, the weight of the occupant is not known. Particularly, in the case of the unit 10 that can be attached to and detached from the vehicle body frame 3, the weight of the occupant and the weight of the vehicle body frame 3 are not known. Therefore, it is difficult to set the appropriate J value at the time of shipment at the factory. However, the J value can be changed by the terminal 85 as in this modified example, whereby, for example, it is possible to set the appropriate J value in consideration of the weight of the occupant and the weight of the vehicle body frame 3 at a sales store.

The change of the J value in the second and third modified examples can be applied not only to the calculation of the actual turning torque value $R_{rl}$ but also to the calculation of other torque values. For example, as described above, it is possible to estimate the manual torque value by calculating the total torque value based upon the detection signals of the encoders 24L and 24R and subtracting the motor torque value from the total torque value, but since the conversion equation "$J \cdot d\omega/dt = T - D\omega$" is also used for the calculation of the total torque value, the accuracy of the total torque value can be improved by allowing the J value to be changeable.

That is, a power assist wheelchair includes a wheel, an electric motor that drives the wheel, an encoder that detects the rotation of the wheel, and a control device that controls the electric motor; the control device includes a torque value calculation unit that calculates a torque value based upon a detection signal of the encoder, and a target current determination unit that determines a target current of the electric motor based upon the torque value; and a coefficient included in a conversion equation for calculating the torque value that can be changed.

In the power assist wheelchair, the control device may change the coefficient in response to a command from a terminal that can communicate with the control device.

The power assist wheelchair further includes a weight sensor that detects a weight of a user on a seat, and the torque value calculation unit may calculate the torque value based upon the detection signal of the encoder and the weight of the user on the seat.

The terminal is a terminal capable of communicating with the control device for the power assist wheelchair including the wheel, the electric motor that drives the wheel, and the encoder that detects the rotation of the wheel, and includes a receiving unit that receives a change of the coefficient included in the conversion equation for calculating the torque value based upon the detection signal of the encoder in the control device, and an output unit that outputs the command for changing the coefficient to the control device.

Other Embodiments

There are various control parameters for the power assist wheelchair, and there is one that can be individually adjusted according to a physical condition of a user and a use environment. However, since the control parameter is generally adjusted by a sales store or a therapist using a personal computer (PC), the control parameter once adjusted cannot be changed during use of the power assist wheelchair. On the other hand, the physical condition of the user may change due to aging and progressive disabilities. The use environment is also usually both indoors and outdoors.

Therefore, in the embodiment described hereinafter, a change in the physical condition of the user and a change in the usage environment are learned, and the controller adjusts the control parameter by itself.

Figure 18:
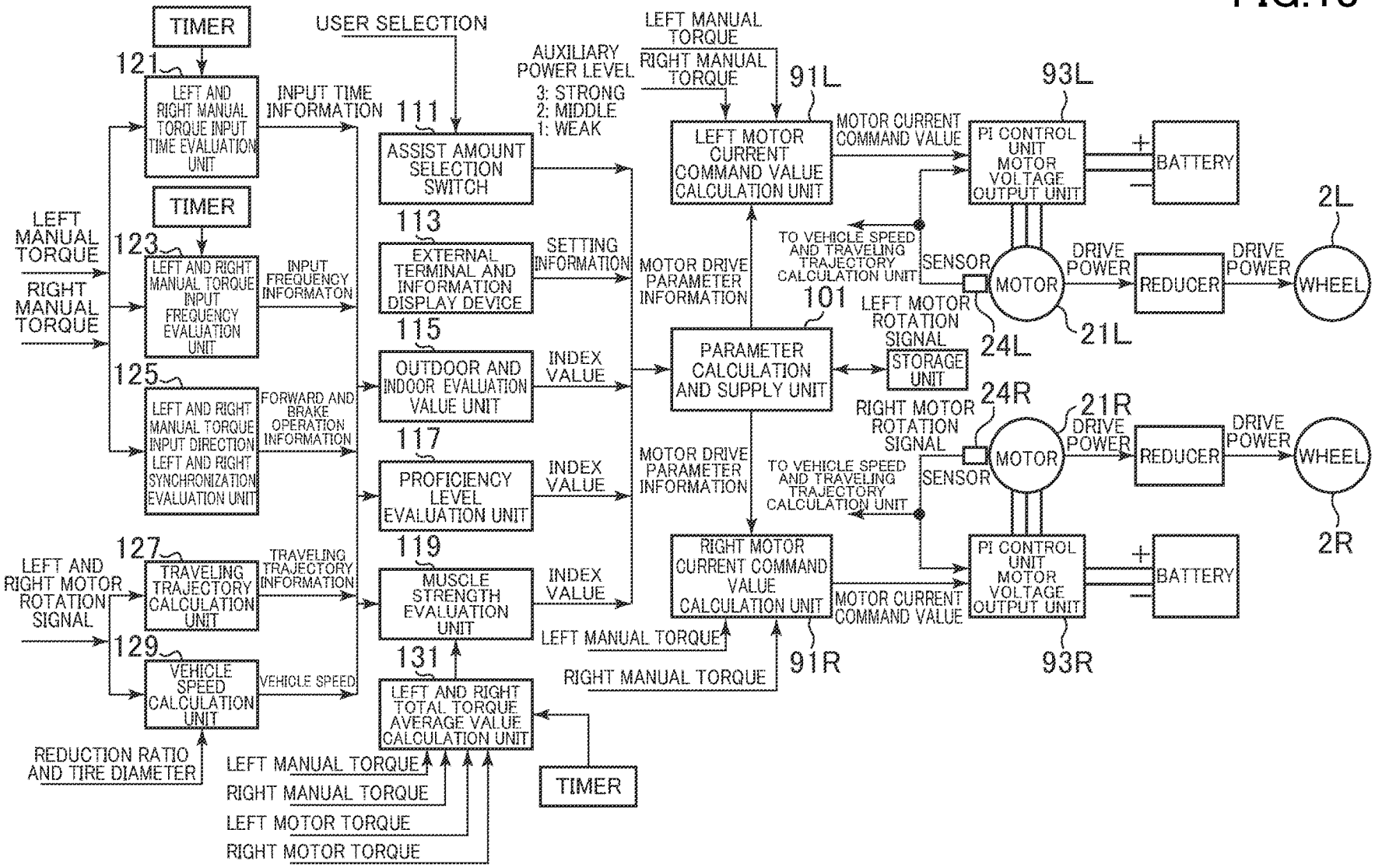
FIG. 18 is a block diagram illustrating a power assist wheelchair according to another embodiment.

FIG. 18 is a block diagram illustrating a configuration example of a power assist wheelchair according to another embodiment. The same configuration as that of the above-described embodiment will be denoted by the same reference sign and detailed description thereof will be omitted.

A left motor current command value calculation unit 91L and a left motor driver 93L are included in the left controller 30L. A right motor current command value calculation unit 91R and a right motor driver 93R are included in the right controller 30R. The motor current command value calculation units 91L and 91R are functional blocks implemented by the controllers 30L and 30R, and the motor drivers 93L and 93R are electric circuits included in the controllers 30L and 30R. The motor current command value calculation units 91L and 91R, calculate a motor current command value based upon the manual torque, and output the calculated motor current command value to the motor drivers 93L and 93R. The motor current command value calculation units 91L and 91R include, for example, the block group illustrated in FIG. 4.

The wheelchair 1 includes a parameter calculation and supply unit 101, an assist amount selection switch 111, an external terminal and information display device 113, an outdoor and indoor evaluation unit 115, a proficiency level evaluation unit 117, a muscle strength evaluation unit 119, a left and right manual torque input time evaluation unit 121, a left and right manual torque input frequency evaluation unit 123, a left and right manual torque input direction left and right synchronization evaluation unit 125, a traveling trajectory calculation unit 127, a vehicle speed calculation unit 129, and a left and right total torque average value calculation unit 131, in addition to the motor current command value calculation units 91L and 91R and the motor drivers 93L and 93R. These block groups may be implemented by one or both of the controllers 30L and 30R, or may be implemented by another controller.

Figure 19:
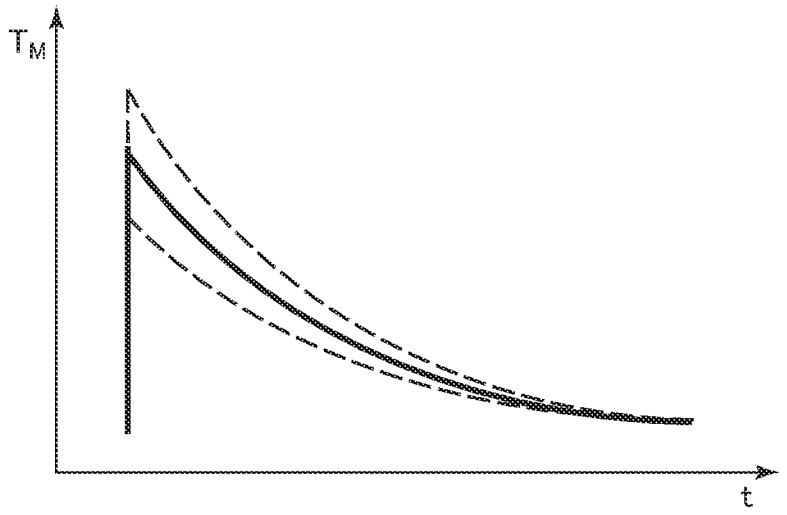
FIG. 19 is a diagram illustrating an example of a relationship between a time and a magnitude of a torque command value.
Figure 20:
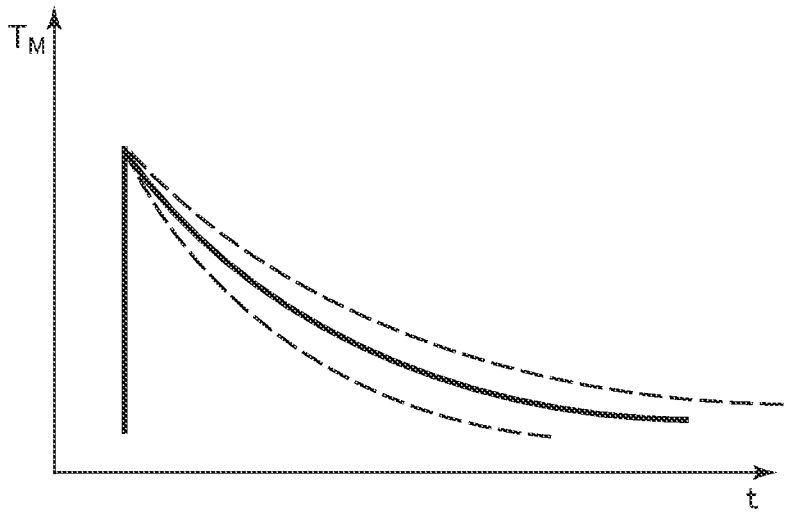
FIG. 20 is a diagram illustrating an example of the relationship between the time and the magnitude of the torque command value.

The motor current command value calculation units 91L and 91R calculate the torque command value based upon the control parameter of the electric motor supplied from the parameter calculation and supply unit 101, and further calculate the motor current command value. The control parameter is, for example, an assist gain (an assist ratio) and a coasting distance (torque output duration). FIGS. 19 and 20 are diagrams illustrating an example of a relationship between a time and a magnitude of a torque command value $T_M$ calculated by the motor current command value calculation units 91L and 91R. The torque command value $T_M$ is calculated so as to have, for example, a profile that is gradually attenuated with the lapse of time after instant rise.

By adjusting the assist gain, the magnitude of the torque command value $T_M$ is adjusted as illustrated in FIG. 19. By adjusting the coasting distance, the duration of the torque command value $T_M$ is adjusted as illustrated in FIG. 20. The coasting distance is a distance at which traveling can be continued with inertia and corresponds to the time during which the output of the motor torque lasts. Specifically, the coasting distance corresponds to a time constant of attenuation of the torque command value $T_M$.

The parameter calculation and supply unit 101 adjusts the control parameter based upon values outputted from the assist amount selection switch 111, the external terminal and information display device 113, the outdoor and indoor evaluation unit 115, the proficiency level evaluation unit 117, and the muscle strength evaluation unit 119. Among these units, the outdoor and indoor evaluation unit 115, the proficiency level evaluation unit 117, and the muscle strength evaluation unit 119 perform evaluation based upon an action mode of the manual torque, and output an index value to the parameter calculation and supply unit 101. The parameter calculation and supply unit 101 changes a predetermined control parameter of the electric motors 21L and 21R to a predetermined magnitude when the action mode of the manual torque satisfies a predetermined condition.

The assist amount selection switch 111 outputs an auxiliary power level selected by a user to the parameter calculation and supply unit 101. The auxiliary power level is set, for example, in three stages. The parameter calculation and supply unit 101 changes the assist gain in response to the selected auxiliary power level. Without being limited thereto, the coasting distance may be changed together with the assist gain.

The external terminal and information display device 113 outputs setting information, set by the user, to the parameter calculation and supply unit 101. The parameter calculation and supply unit 101 changes the control parameter in response to the setting information. The external terminal may be, for example, a portable information terminal such as a smartphone. The information display device may be, for example, a thin display panel including a touch panel.

The outdoor and indoor evaluation unit 115 determines a type of traveling environment of the wheelchair 1 and outputs the index value to the parameter calculation and supply unit 101. The type of the traveling environment is, for example, an outdoor place and an indoor place. The outdoor and indoor evaluation unit 115 determines the type of traveling environment based upon the action mode of the manual torque. Without being limited thereto, the outdoor and indoor evaluation unit 115 may determine the type of traveling environment based upon position information. Details of an operation of the outdoor and indoor evaluation unit 115 will be described later.

The proficiency level evaluation unit 117 determines a proficiency level of the user with respect to the driving of the wheelchair 1 and outputs the index value to the parameter calculation and supply unit 101. The proficiency level evaluation unit 117 determines the proficiency level of the user based upon the action mode of the manual torque. For example, the proficiency level evaluation unit 117 determines the proficiency level of the user based upon information on the manual torque in the past stored in the storage unit. Details of an operation of the proficiency level evaluation unit 117 will be described later.

The muscle strength evaluation unit 119 determines the muscle strength of the user who drives the wheelchair 1 and outputs the index value to the parameter calculation and supply unit 101. The muscle strength evaluation unit 119 determines the muscle strength of the user based upon the action mode of the manual torque. For example, the muscle strength evaluation unit 119 determines the muscle strength of the user based upon information on the manual torque in the past stored in the storage unit. Details of an operation of the muscle strength evaluation unit 119 will be described later.

Evaluation by the outdoor and indoor evaluation unit 115, the proficiency level evaluation unit 117, and the muscle strength evaluation unit 119 is performed based upon information on the left and right manual torque input time evaluation unit 121, the left and right manual torque input frequency evaluation unit 123, the left and right manual torque input direction left and right synchronization evaluation unit 125, the traveling trajectory calculation unit 127, the vehicle speed calculation unit 129, and the left and right total torque average value calculation unit 131.

The left and right manual torque input time evaluation unit 121 evaluates input time of the left manual torque and the right manual torque, and outputs input time information to the outdoor and indoor evaluation unit 115, the proficiency level evaluation unit 117, and the muscle strength evaluation unit 119. The left and right manual torque input frequency evaluation unit 123 evaluates an input frequency of the left manual torque and the right manual torque, and outputs input frequency information to the outdoor and indoor evaluation unit 115, the proficiency level evaluation unit 117, and the muscle strength evaluation unit 119.

The left and right manual torque input direction left and right synchronization evaluation unit 125 evaluates an input direction of the left manual torque and the right manual torque and left and right synchronization thereof, and outputs forward and brake operation information, indicating whether a forward operation or a brake operation is performed, to the outdoor and indoor evaluation unit 115, the proficiency level evaluation unit 117, and the muscle strength evaluation unit 119.

The traveling trajectory calculation unit 127 calculates a traveling trajectory of the wheelchair 1 based upon the detection signals of the encoders 24L and 24R, and outputs traveling trajectory information to the outdoor and indoor evaluation unit 115, the proficiency level evaluation unit 117, and the muscle strength evaluation unit 119. The vehicle speed calculation unit 129 calculates the vehicle speed based upon the detection signals of the encoders 24L and 24R, a reduction ratio, and a tire diameter, and outputs vehicle speed information to the outdoor and indoor evaluation unit 115, the proficiency level evaluation unit 117, and the muscle strength evaluation unit 119.

The left and right total torque average value calculation unit 131 calculates an average value of left and right total torque (manual torque+motor torque) based upon the left manual torque, the right manual torque, left motor torque, and right motor torque, and outputs the average value thereof to the muscle strength evaluation unit 119.

The control parameter to be adjusted may be the counter torque value $R_{cp}$ (a compensation turning torque value) in the above-described single flow control. For example, the parameter calculation and supply unit 101 may change the counter torque value $R_{cp}$ to a predetermined magnitude when the action mode of the manual torque satisfies a predetermined condition. The parameter calculation and supply unit 101 may change the counter torque value $R_{cp}$ to the predetermined magnitude based upon a determined type of the traveling environment. Specifically, for example, the magnitude of the basic counter torque value with respect to the external torque ET acting on the wheelchair 1 may be adjusted, and for example, the magnitude of the gain in the low-speed region multiplied by the basic counter torque value may be adjusted.

[Indoor and Outdoor Determination]

Hereinafter, determination of the traveling environment executed by the outdoor and indoor evaluation unit 115 will be described.

The optimal control parameters are different depending on a case where the wheelchair 1 is used outdoors and a case where the wheelchair 1 is used indoors. For example, in the case where the wheelchair 1 is used outdoors, it is desirable that the coasting distance and the assist gain are relatively large, but when the wheelchair 1 is used indoors with the-above described setting as it is, the auxiliary power is easily applied and the operation may be difficult. On the contrary, in the case where the wheelchair 1 is used indoors, it is desirable that the coasting distance and the assist gain are relatively small, but when the wheelchair 1 is used outdoors with the-above described setting as it is, the auxiliary power may be insufficient and the burden on the user may increase. Generally, since the control parameter is adjusted by a sales store or therapist using a PC and cannot be changed during use of the wheelchair, when the control parameter is set once, the user should continue to use the control parameter as it is even though the user feels inconvenience.

Therefore, in the embodiment, the outdoor and indoor evaluation unit 115 determines the traveling environment and sets the control parameter suitable for the traveling environment.

First Example

For example, when the user of the wheelchair 1 drives the hand rim 13 and drives the hand rim 13 again before the vehicle speed sufficiently drops, the outdoor and indoor evaluation unit 115 determines that the wheelchair 1 is used outdoors. Specifically, the outdoor and indoor evaluation unit 115 determines that the wheelchair 1 is used outdoors when the input of the left and right manual torque repeats the presence and absence of the input almost at the same time in the forward direction while the vehicle speed is maintained at a predetermined value or more, based upon information from the left and right manual torque input frequency evaluation unit 123, the left and right manual torque input direction left and right synchronization evaluation unit 125, and the vehicle speed calculation unit 129.

For example, when a state where a torque input time per row when the user of the wheelchair 1 drives the hand rim 13 is relatively long repeatedly occurs, the outdoor and indoor evaluation unit 115 may determine that the wheelchair 1 is used outdoors. Specifically, when the input of the left and right manual torque for a fixed time or longer repeats the presence and absence of the input almost at the same time in the forward direction, the outdoor and indoor evaluation unit 115 determines that the wheelchair 1 is used outdoors, based upon information from the left and right manual torque input time evaluation unit 121, the left and right manual torque input frequency evaluation unit 123, the left and right manual torque input direction left and right synchronization evaluation unit 125.

When it is determined that the wheelchair 1 is used outdoors, the parameter calculation and supply unit 101 sets and stores the control parameter for outdoor use. Specifically, when it is determined that the wheelchair 1 is used outdoors, the parameter calculation and supply unit 101 increases, for example, the coasting distance. Without being limited thereto, for example, both the coasting distance and the assist gain may be increased. Since the control parameter is stored in the auxiliary storage unit (for example, the non-volatile semiconductor memory) included in the storage unit, even though the power is turned off, the control parameter starts from the previous setting when the power is turned on again.

A determination result of the traveling environment by the outdoor and indoor evaluation unit 115 is not limited to the two stages of the outdoor place and indoor place, and may be divided into, for example, three or more stages. By providing an intermediate stage, it is possible to prepare setting of the control parameter suitable for a slightly wide indoor floor facility such as, for example, a hospital and a shopping center.

Figure 21:
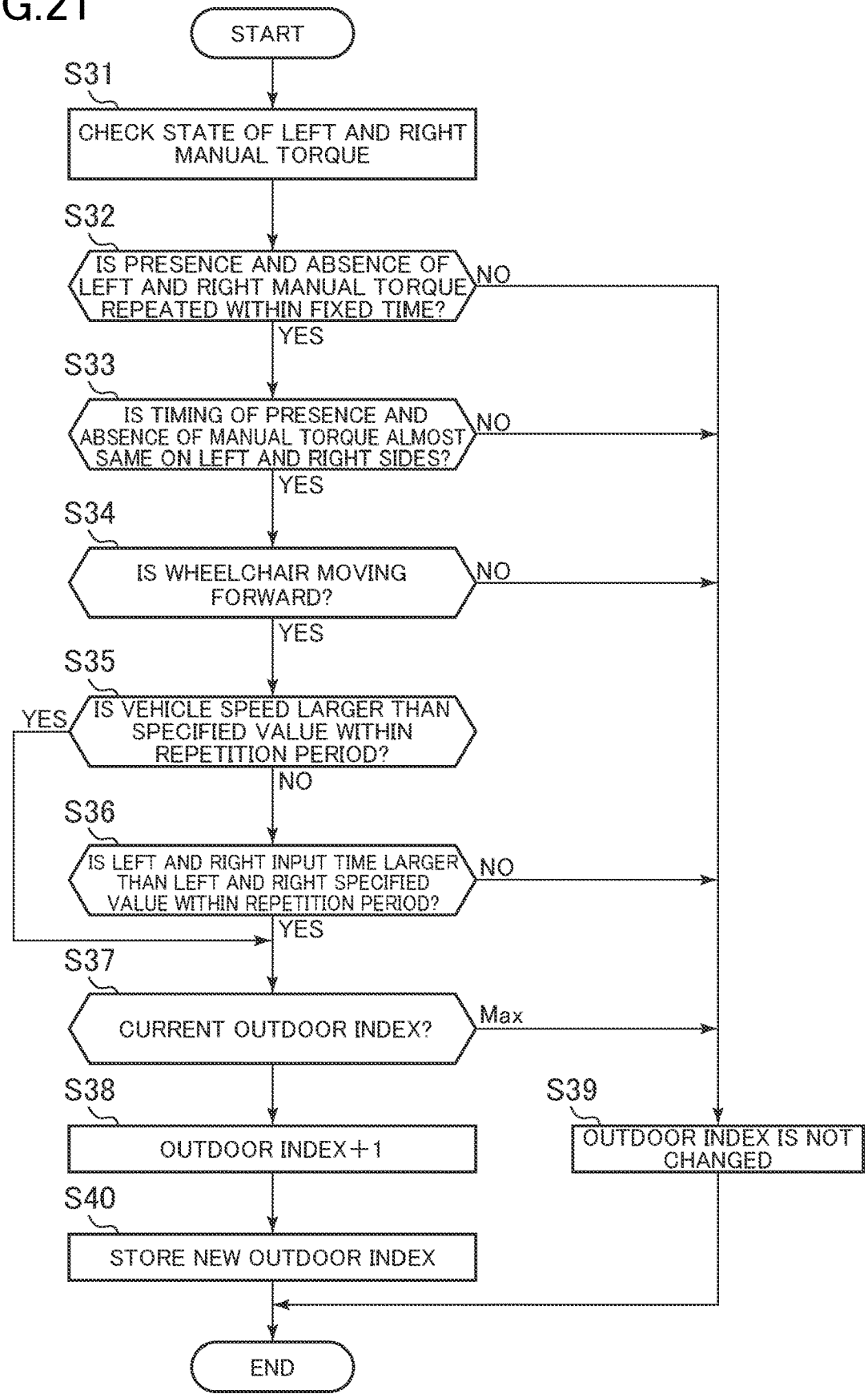
FIG. 21 is a flowchart illustrating an example of processing for evaluating an outdoor place and an indoor place.

FIG. 21 is a flowchart illustrating a first example. First, the outdoor and indoor evaluation unit 115 checks a state of the left and right manual torque (S31). The outdoor and indoor evaluation unit 115 determine whether the presence and absence of the input of the left and right manual torque is repeated within a fixed time (S32), whether a timing of the presence and absence of the input of the left and right manual torque is almost the same on the left and right sides (S33), and whether the wheelchair 1 moves forward (S34).

When all of S32 to S34 are YES, the outdoor and indoor evaluation unit 115 determines whether or not the vehicle speed is greater than a specified value within a repetition period during which the presence and absence of the input of the left and right manual torque is repeated (S35). When S35 is YES, the processing proceeds to S37. On the other hand, when S35 is NO, the outdoor and indoor evaluation unit 115 determines whether or not the input time of the left and right manual torque is longer than a specified value within the repetition period (S36). When S36 is YES, the processing proceeds to S37.

When S35 or S36 is YES, the outdoor and indoor evaluation unit 115 acquires a current outdoor index (S37). As illustrated in an example of FIG. 22, the outdoor index is, for example, a multi-stage index of 0 to n (n is a natural number equal to or greater than 2), indicates that the traveling environment is closed to the outdoor place as the outdoor index is greater, and indicates that the traveling environment is closed to the indoor place as the outdoor index is smaller. The control parameter is also set in response to the outdoor index. For example, the coasting distance and the torque output duration are set to be longer as the outdoor index is greater, and the coasting distance the torque output duration are set to be shorter as the outdoor index is smaller. The assist gain is set to be greater as the outdoor index is greater, and the assist gain is set to be smaller as the outdoor index is smaller.

When the acquired current outdoor index is not the maximum value (S37), the outdoor and indoor evaluation unit 115 adds 1 to the outdoor index (S38), and stores a new outdoor index in the storage unit (S40). The outdoor index stored in the storage unit is read by the parameter calculation and supply unit 101 and supplied to the motor current command value calculation units 91L and 91R.

On the other hand, when the acquired current outdoor index is the maximum value (S37), the outdoor and indoor evaluation unit 115 terminates the processing without changing the outdoor index (S39). Even though any of S32 to S34 and S36 is NO, the outdoor and indoor evaluation unit 115 terminates the processing without changing the outdoor index (S39).

Figure 23:
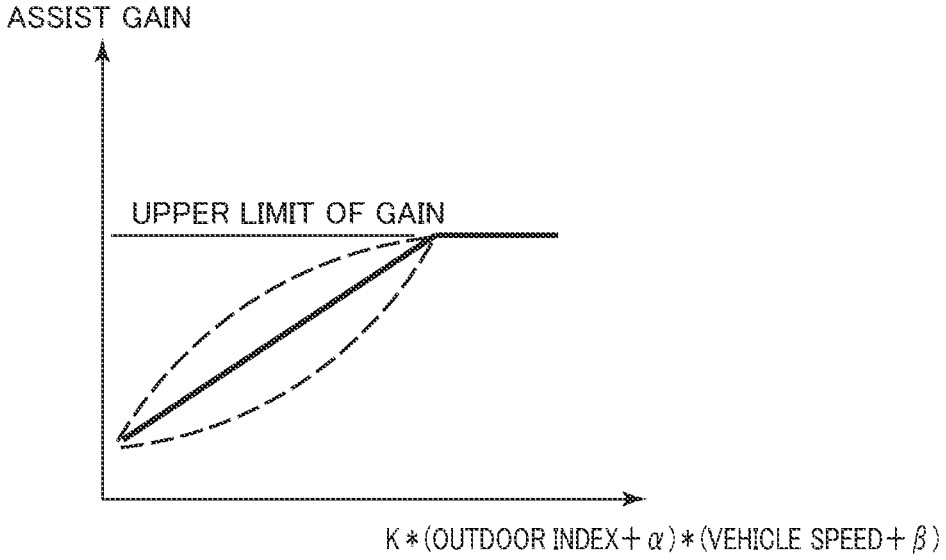
FIG. 23 is a diagram illustrating a relationship between an outdoor index, a vehicle speed, and an assist gain.

As illustrated in an example of FIG. 23, the assist gain is determined based upon, for example, the vehicle speed and the outdoor index. Specifically, the assist gain corresponding to the vehicle speed and the outdoor index is calculated by using a map representing a relationship between the vehicle speed, the outdoor index, and the assist gain. For example, the assist gain is set so as to linearly increase up to an upper limit as K*(outdoor index+$\alpha$)*(vehicle speed+$\beta$) increases. K, $\alpha$, and $\beta$ are constants. Without being limited thereto, the increase in the assist gain may be a non-linear curve as shown by a broken line in the drawing.

Second Example

For example, when the user of the wheelchair 1 drives the hand rim 13 and applies the brake before the speed is sufficiently increased, the outdoor and indoor evaluation unit 115 determines that the wheelchair 1 is used indoors. Specifically, when the input of the left and right manual torque repeats the presence and absence of the input almost at the same time in the forward direction or the backward direction, and a brake operation (input in the opposite direction) is performed during the increase or maintenance of the vehicle speed, the outdoor and indoor evaluation unit 115 determines that the wheelchair 1 is used indoors, based upon information from the left and right manual torque input direction left and right synchronization evaluation unit 125 and the vehicle speed calculation unit 129.

For example, when the input time of the manual torque per row when the user of the wheelchair 1 drives the hand rim 13 is short and the magnitude is small, the outdoor and indoor evaluation unit 115 may determine that the wheelchair 1 is used indoors. For example, when an operation for rowing in the forward direction or the backward direction and the brake operation (input in the opposite direction) are mixed within a fixed time, the outdoor and indoor evaluation unit 115 may determine that the wheelchair 1 is used indoors.

When it is determined that the wheelchair 1 is used indoors, the parameter calculation and supply unit 101 sets and stores the control parameter for indoor use. Specifically, when it is determined that the wheelchair 1 is used indoors, for example, the outdoor and indoor evaluation unit 115 reduces the coasting distance. Without being limited thereto, for example, both the coasting distance and the assist gain may be reduced.

Figure 24:
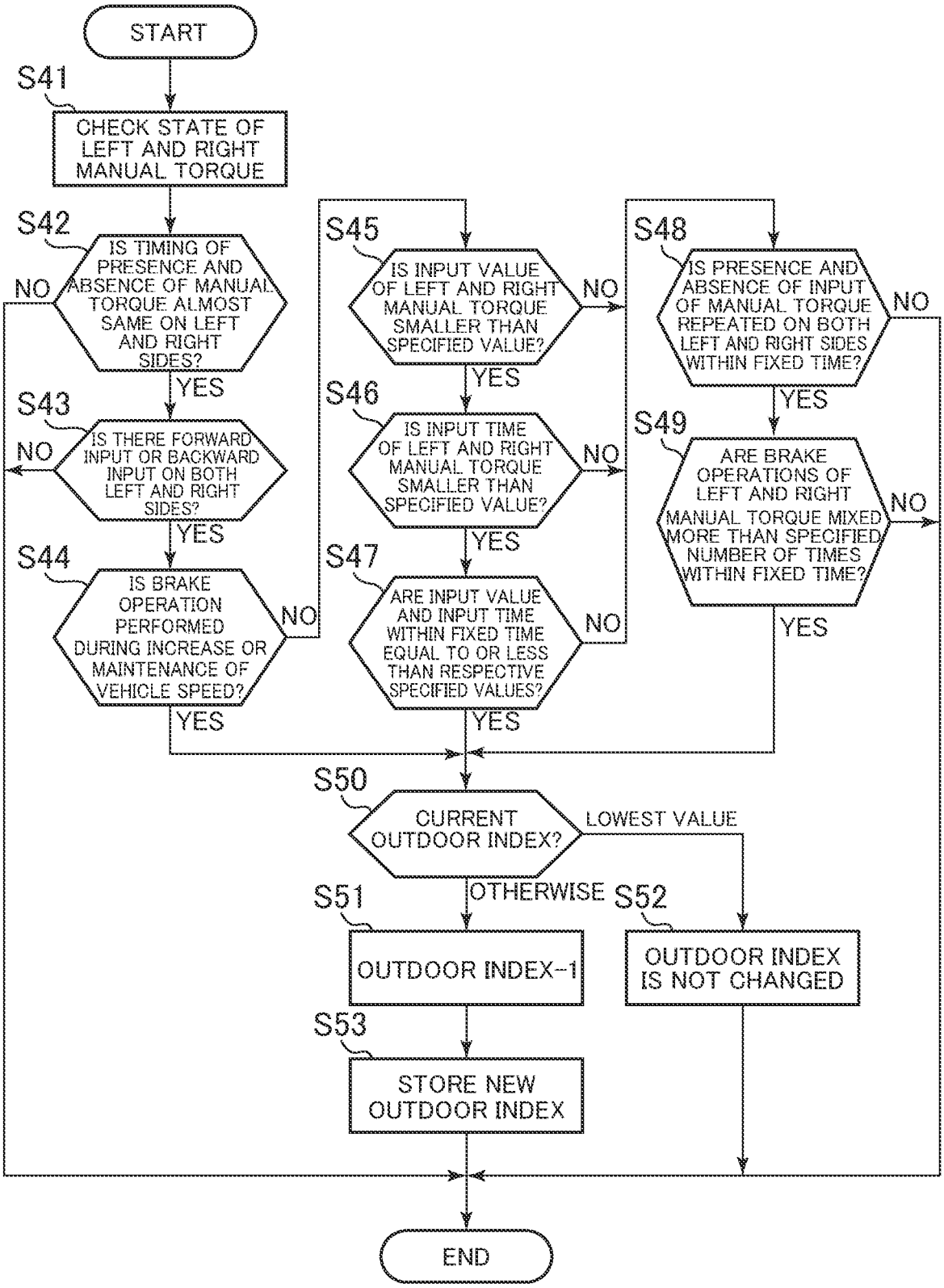
FIG. 24 is a flowchart illustrating an example of processing for evaluating the outdoor place and the indoor place.

FIG. 24 is a flowchart illustrating a second example. First, the outdoor and indoor evaluation unit 115 checks a state of the left and right manual torque (S41). The outdoor and indoor evaluation unit 115 determines whether the timing of the presence and absence of the input of the left and right manual torque is almost the same on the left and right sides (S42), whether the wheelchair 1 moves forward or backward (S43), and whether the brake operation is performed during the increase or maintenance of the vehicle speed (S44). When S44 is YES, the processing proceeds to S50.

When S44 is NO, the outdoor and indoor evaluation unit 115 determines whether or not an input value (a magnitude) of the left and right manual torque is smaller than a specified value (S45), whether or not the input time of the left and right manual torque is shorter than a specified value (S46), and whether or not the input value and the input time of the left and right manual torque within a fixed time are equal to or less than the respective specified values (S47). When S47 is YES, the processing proceeds to S50.

When S47 is NO, the outdoor and indoor evaluation unit 115 determines whether or not the presence and absence of the input of the manual torque is repeated on both the left and right within a fixed time (S48), and whether or not the brake operations of the left and right manual torque are mixed more than a specified number of times within a fixed time (S49). When S49 is YES, the processing proceeds to S50.

When S44 and S47 or S49 is YES, the outdoor and indoor evaluation unit 115 acquires the current outdoor index (S50). When the acquired current outdoor index is not the lowest value (S50), the outdoor and indoor evaluation unit 115 subtracts 1 from the outdoor index (S51), and stores a new outdoor index in the storage unit (S53).

On the other hand, when the acquired current outdoor index is the lowest value (S50), the outdoor and indoor evaluation unit 115 terminates the processing without changing the outdoor index (S52). Even when any of S42, S43, S48, and S49 is NO, the outdoor and indoor evaluation unit 115 terminates the processing.

Third Example

In this example, it is possible to adjust a speed of reflecting a result of learning. That is, it is possible to adjust a speed of changing the index value such as an outdoor index value or a speed of changing the control parameter corresponding to the index value. Hereinafter, the outdoor index value is cited as an example, but other index values or control parameters may be targets to be adjusted.

Figure 25:
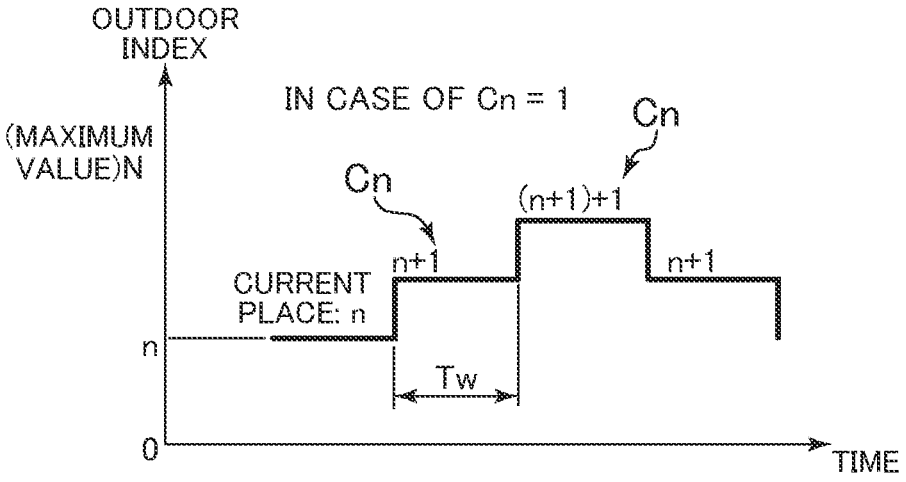
FIG. 25 is a diagram illustrating an example of a time change in the outdoor index.
Figure 26:
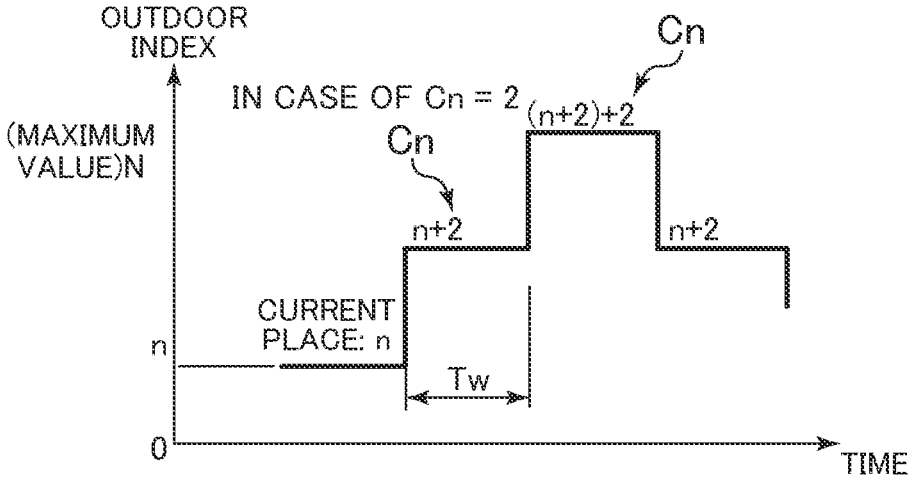
FIG. 26 is a diagram illustrating an example of a time change in the outdoor index.

FIGS. 25 and 26 are diagrams illustrating an example of a time change in the outdoor index. A horizontal axis represents the time, and a vertical axis represents the outdoor index value. In the illustrated example, a waiting time Tw until the outdoor index value n is changed and an increase and decrease width Cn when the outdoor index value n is changed can be adjusted. The outdoor index value n is changed by the increase and decrease width Cn when a condition is met each time the waiting time Tw elapses.

By reducing the waiting time Tw or increasing the increase and decrease width Cn, the control parameter can be quickly coped with the traveling environment. On the other hand, by increasing the waiting time Tw or reducing the increase and decrease width Cn, it is possible to secure time for the user to get used to the control parameter.

Figure 27:
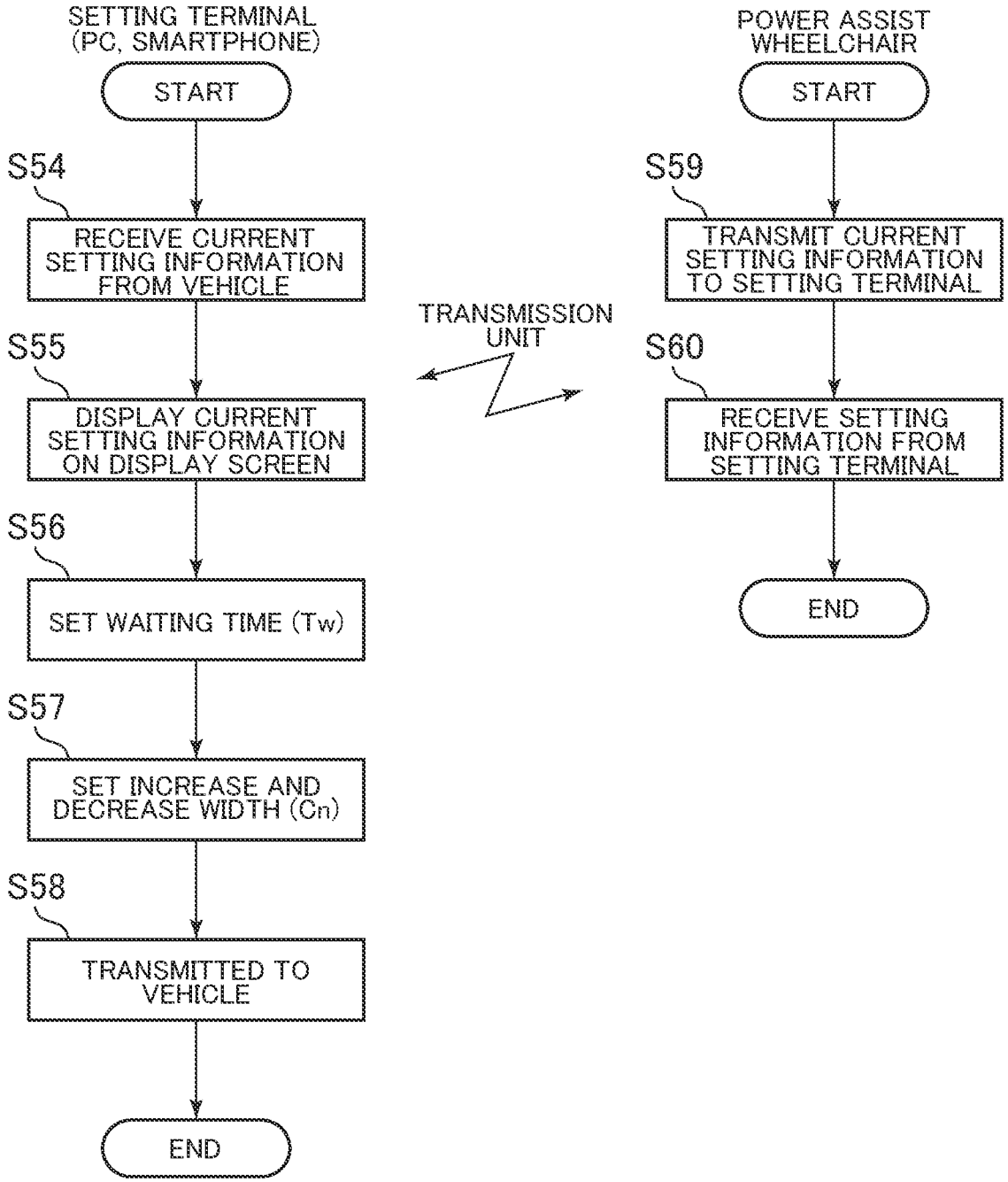
FIG. 27 is a flowchart illustrating a setting example of a waiting time and an increase and decrease width.

FIG. 27 is a flowchart illustrating a setting example of the waiting time Tw and the increase and decrease width Cn. In the illustrated example, the setting of the waiting time Tw and the increase and decrease width Cn is performed by a setting terminal capable of communicating with the wheelchair 1. The setting terminal is, for example, a PC or a smartphone.

First, the wheelchair 1 transmits current setting information to the setting terminal (S59). When receiving the current setting information from the wheelchair 1 (S54), the setting terminal displays the current setting information on a display screen (S55).

Next, the setting terminal sets the waiting time Tw (S56), and sets the increase and decrease width Cn (S57). The waiting time Tw is the minimum waiting time until the next outdoor index value is changed after the outdoor index value is changed. The increase and decrease width Cn is an increase and decrease width per change when the outdoor index value is changed.

The setting terminal includes an input device such as, for example, a touch panel or a keyboard, and receives the input of the waiting time Tw and the increase and decrease width Cn from the user. Without being limited thereto, for example, the setting terminal may display a plurality of candidates of the waiting time Tw and the increase and decrease width Cn on a display device such as a liquid crystal display panel, and receive selection of the candidates.

Next, the setting terminal transmits the set waiting time Tw and increase and decrease width Cn to the wheelchair 1 as new setting information (S58). The wheelchair 1 receives the new setting information from the setting terminal (S60) and stores the new setting information in the storage unit. Accordingly, the waiting time Tw and the increase and decrease width Cn set by the setting terminal can be used by the wheelchair 1.

Figure 28:
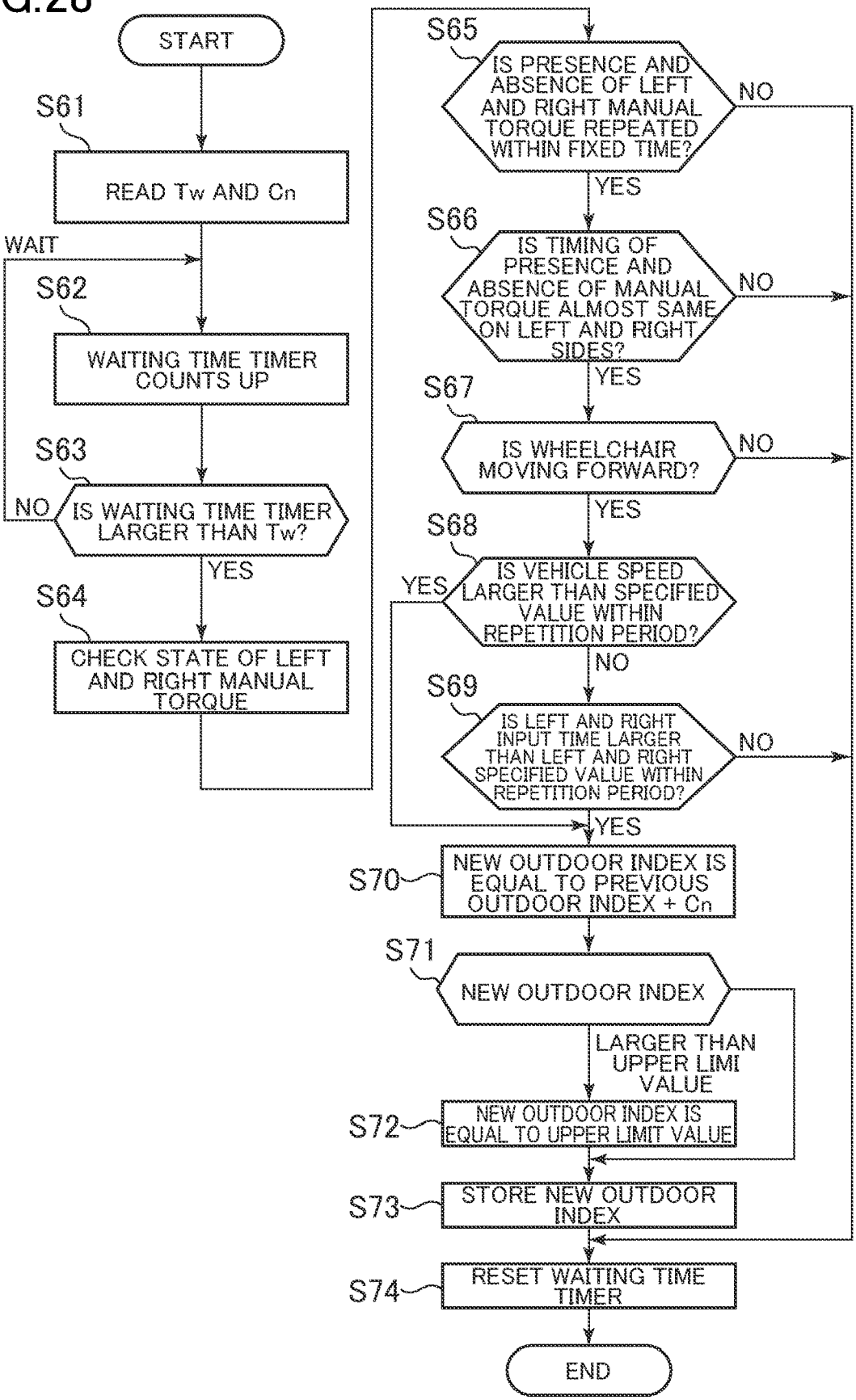
FIG. 28 is a flowchart illustrating a third example of processing for evaluating the outdoor place and the indoor place.

FIG. 28 is a flowchart illustrating a processing example of outdoor and indoor evaluation using the waiting time Tw and the increase and decrease width Cn. First, the outdoor and indoor evaluation unit 115 reads the waiting time Tw and the increase and decrease width Cn stored in the storage unit (S61). Next, when a waiting time timer starts to count up (S62) and the time counted by the waiting time timer exceeds the waiting time Tw (S63: YES), the outdoor and indoor evaluation unit 115 proceeds to S64.

Since S64 to S69 are the same as S31 to S36 of FIG. 21, the detailed description thereof will be omitted.

When S68 or S69 is YES, the outdoor and indoor evaluation unit 115 calculates a new outdoor index by adding the increase and decrease width Cn to the previous outdoor index (S70). Next, when the new outdoor index is equal to or smaller than an upper limit value (S71), the outdoor and indoor evaluation unit 115 stores the new outdoor index as it is (S73). On the other hand, when the new outdoor index is greater than the upper limit value (S71), the outdoor and indoor evaluation unit 115 stores the upper limit value as the new outdoor index (S72 and S73). Thereafter, the outdoor and indoor evaluation unit 115 resets the waiting time timer (S74), and terminates the processing.

[Muscle Strength Evaluation]

Hereinafter, muscle strength evaluation performed by the muscle strength evaluation unit 119 will be described.

In general, physical functions of physically challenged people are generally very different as compared with healthy people, and differ from person to person. For example, with regard to an upper body, while some people have arm strength comparable to that of the healthy people, other people have reduced arm strength and grip strength of both arms or one arm, and a reduced movable region. Therefore, it is desirable that the control parameter of the wheelchair is individually set in response to the physical condition of each user. For example, when the arm strength is different between the left and right sides, setting is performed so that the assist gain of the electric motor on the side where the arm strength is weaker is set to be increased. However, since the control parameter is generally adjusted by a sales store or a therapist using a PC and cannot be changed during the use, once the control parameter is set, the control parameter should be used as it is even though the physical condition of the user changes.

Therefore, in the embodiment, the muscle strength evaluation unit 119 evaluates the muscle strength of the user, and sets the control parameter suitable for the muscle strength of the user.

In the first example, the muscle strength evaluation unit 119 acquires information on the manual torque accumulated and stored in the storage unit, and when the magnitude of the manual torque decreases over time, the muscle strength evaluation unit 119 determines that the muscle strength of the user is reduced. When it is determined that the muscle strength of the user is reduced, for example, the parameter calculation and supply unit 101 increases the assist gain. Without being limited thereto, for example, both the assist gain and the coasting distance may be increased.

In the second example, the muscle strength evaluation unit 119 compares an average value of a total value of the manual torque and the motor torque in a predetermined period (for example, one week) acquired from the left and right total torque average value calculation unit 131 on the left and right sides, and determines which muscle strength of the left and right arms is reduced. Instead of the total value, average values of only manual torque on the left and right sides may be compared with each other. The parameter calculation and supply unit 101 increases the assist gain on the side where it is determined that the muscle strength is reduced.

Figure 29:
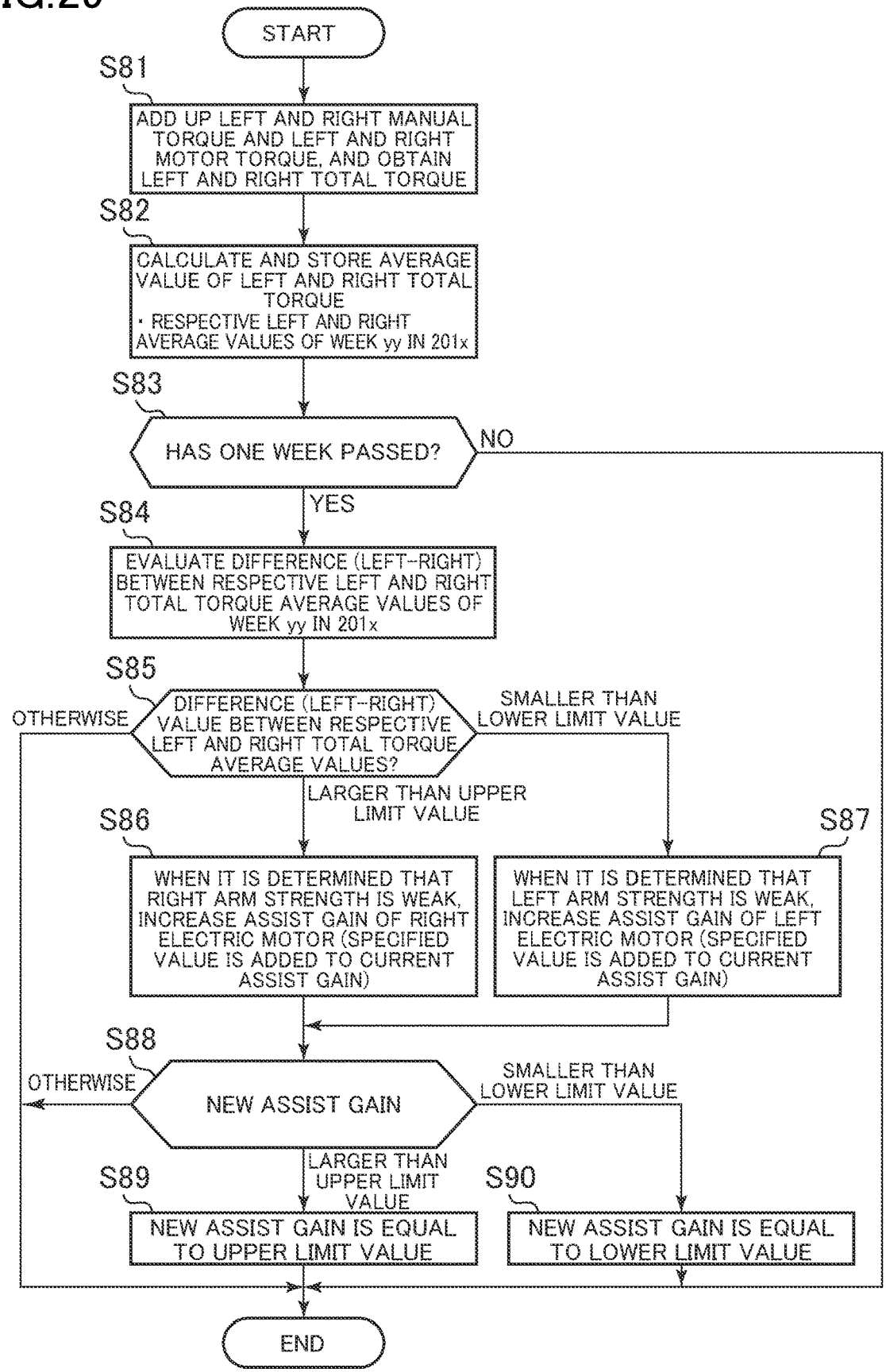
FIG. 29 is a flowchart illustrating an example of processing for evaluating muscle strength.

FIG. 29 is a flowchart illustrating the second example. First, when there is input of the manual torque, the muscle strength evaluation unit 119 obtains left total torque by adding the left manual torque and the left motor torque, and obtains right total torque by adding the right manual torque and the right motor torque (S81). Next, the muscle strength evaluation unit 119 calculates and stores an average value of the left and right total torque (S82). Calculation of each of the left and right average values is performed, for example, every week (S83). Thus, for example, each of the left and right average values of the week yy in 201*x* is calculated. Without being limited thereto, the calculation of each of the left and right average values may be performed, for example, every month, every half year, and every year. The calculation of each of the left and right average values is performed for a period in which the manual torque is inputted for one week (that is, a period excluding a period during which there is no input).

When one week passes and each of the left and right average values is calculated, the muscle strength evaluation unit 119 evaluates a difference between the left and right average values (S84). Here, for example, the difference therebetween is calculated by subtracting the right average value from the left average value. When the difference between the left and right average values is greater than an upper limit value (for example, a positive value) (S85), the muscle strength evaluation unit 119 determines that the right arm strength is weak and relatively increases the assist gain of the right electric motor 21R (S86). On the other hand, when the difference between the left and right average values is smaller than a lower limit value (for example, a negative value) (S85), the muscle strength evaluation unit 119 determines that the left arm strength is weak, and relatively increases the assist gain of the left electric motor 21L (S87). Here, for example, the assist gain is increased by adding a specified value to the current assist gain on the side where the arm strength is determined to be weak. Without being limited thereto, for example, the assist gain may be reduced by subtracting a specified value from the current assist gain on the side opposite to the side where the arm strength is determined to be weak.

Thereafter, when a new assist gain is greater than the upper limit value (S88), the muscle strength evaluation unit 119 sets the upper limit value as the new assist gain (S89), and terminates the processing. When the new assist gain is smaller than the lower limit value (S88), the muscle strength evaluation unit 119 sets the lower limit value as the new assist gain (S90), and terminates the processing. When the new assist gain is smaller than the upper limit value and greater than the lower limit value (S88), the muscle strength evaluation unit 119 terminates the processing as it is.

In a third example, the muscle strength evaluation unit 119 compares input frequency of the manual torque while the wheelchair 1 travels straight as a whole on the left and right sides based upon information from the left and right manual torque input frequency evaluation unit 123 and the traveling trajectory calculation unit 127, thereby determining which muscle strength of the left and right arms is reduced. That is, when the wheelchair 1 slightly meanders but travels straight as a whole, since there is a possibility that the muscle strength of either one of the left and right arms may be reduced, the muscle strength evaluation unit 119 accumulates and stores the input frequency of the manual torque while the wheelchair 1 travels straight as a whole for a fixed period, and compares the stored input frequency thereof on the left and right sides.

In a fourth example, the muscle strength evaluation unit 119 compares a time integral value of a total value of the manual torque and the motor torque in a predetermined period (for example, one week) on the left and right sides, thereby determining which muscle strength of the left and right arms is reduced. Instead of the total value, time integral values of only manual torque on the left and right sides may be compared with each other. The parameter calculation and supply unit 101 increases the assist gain on the side where it is determined that the muscle strength is reduced.

Figure 30:
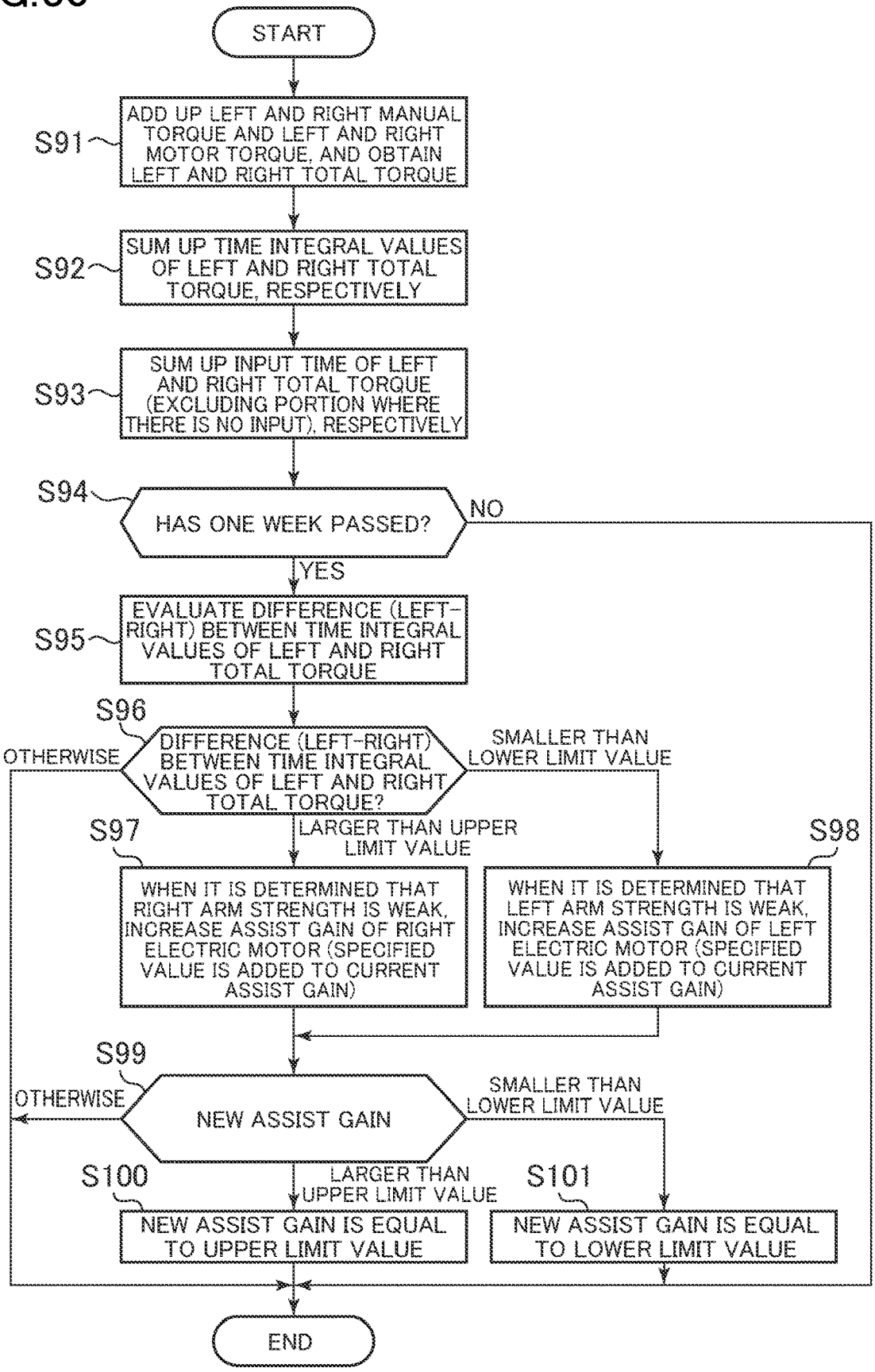
FIG. 30 is a flowchart illustrating an example of processing for evaluating the muscle strength.

FIG. 30 is a flowchart illustrating a fourth example. First, when there is input of the manual torque, the muscle strength evaluation unit 119 obtains left total torque by adding the left manual torque and the left motor torque, and obtains right total torque by adding the right manual torque and the right motor torque (S91). Next, the muscle strength evaluation unit 119 sums up time integral values of the left and right total torque, respectively (S92). The muscle strength evaluation unit 119 sums up input time of the left and right total torque, respectively (S93). Here, the input time of the total torque is obtained by excluding a portion where there is no input. The muscle strength evaluation unit 119 calculates the sum of the time integral values of the total torque until the sum of the input time of the total torque exceeds one week (S94). Without being limited thereto, for example, the calculation may be performed every week.

When the sum of the input time of the total torque exceeds one week, the muscle strength evaluation unit 119 evaluates a difference between the time integral values of the left and right total torque (S95). Here, for example, the difference is calculated by subtracting a right time integral value from a left time integral value. When the difference between the left and right time integral values is greater than an upper limit value (for example, a positive value) (S96), the muscle strength evaluation unit 119 determines that the right arm strength is weak and relatively increases the assist gain of the right electric motor 21R (S97). On the other hand, when the difference between the left and right time integral values is smaller than a lower limit value (for example, a negative value) (S96), the muscle strength evaluation unit 119 determines that the left arm strength is weak, and relatively increases the assist gain of the left electric motor 21L (S98). Here, for example, the assist gain is increased by adding a specified value to the current assist gain on the side where it is determined that the arm strength is weak. Without being limited thereto, for example, the assist gain may be reduced by subtracting the specified value from the current assist gain on the side opposite to the side where it is determined that the arm strength is weak.

Thereafter, when a new assist gain is greater than the upper limit value (S99), the muscle strength evaluation unit 119 sets the upper limit value as the new assist gain (S100), and terminates the processing. When the new assist gain is smaller than the lower limit value (S99), the muscle strength evaluation unit 119 sets the lower limit value as the new assist gain (S101), and terminates the processing. When the new assist gain is smaller than the upper limit value and greater than the lower limit value (S99), the muscle strength evaluation unit 119 terminates the processing as it is.

[Proficiency Level Evaluation]

In the embodiment, the proficiency level evaluation unit 117 evaluates the proficiency level of the user, and sets the control parameter in response to the proficiency level of the user. For example, the proficiency level evaluation unit 117 calculates the total of the input time based upon information from the left and right manual torque input time evaluation unit 121, and gradually increases the upper limit value such as the assist gain, the coasting distance, and the vehicle speed as the total of the input time increases.

Figure 31:
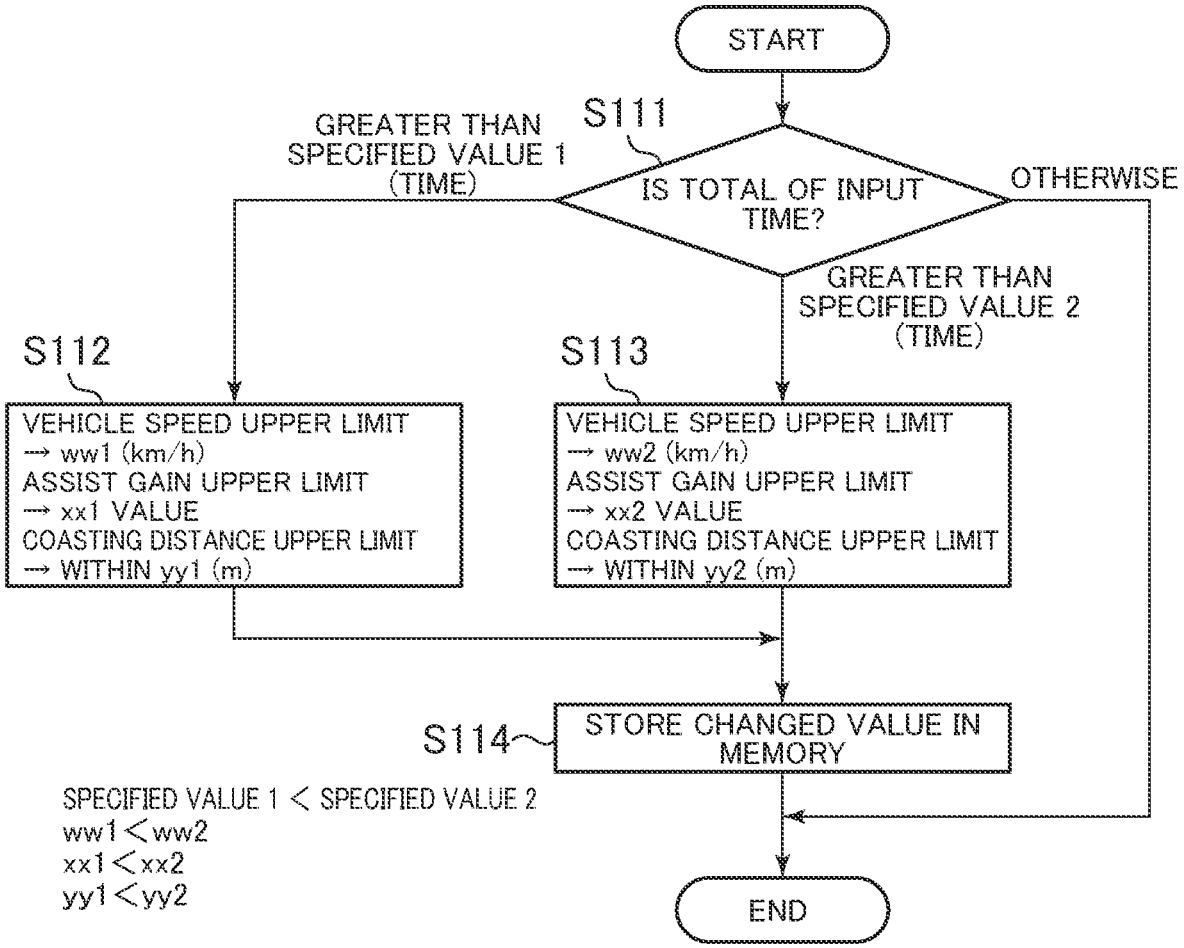
FIG. 31 is a flowchart illustrating an example of processing for evaluating a proficiency level.

FIG. 31 is a flowchart illustrating a processing example for evaluating the proficiency level. The proficiency level evaluation unit 117 acquires the total of the input time of the manual torque (S111), and when the total of the input time is shorter than a specified value 1, the proficiency level evaluation unit 117 keeps the upper limit value of the assist gain, the coasting distance, and the vehicle speed at a lowest first stage (a LOW level).

When the total of the input time is equal to or greater than the specified value 1 (S111), the proficiency level evaluation unit 117 raises the upper limit value of the assist gain, the coasting distance, and the vehicle speed to a next second stage (a MID level) (S112), and stores the changed value in a memory (S114). Each upper limit value in the second stage is greater than that in the first stage.

When the total of the input time is greater than or equal to a specified value 2 greater than the specified value 1 (S111), the proficiency level evaluation unit 117 further raises the upper limit value of the assist gain, the coasting distance, and the vehicle speed to a next third stage (a HIGH level) (S113), and stores the changed value in the memory (S114). Each upper limit value in the third stage is greater than that in the first stage.

The power assist wheelchair according to another embodiment described above includes a wheel, an electric motor that drives the wheel, an encoder that detects rotation of the wheel, and a control device that controls the electric motor. The control device includes an acquisition unit that acquires information on manual torque acting on the wheel; a determination unit that determines whether or not an action mode of the manual torque satisfies a predetermined condition; and a change unit that changes a predetermined control parameter of the electric motor to a predetermined magnitude when the action mode of the manual torque satisfies the predetermined condition.

The control device further includes a storage unit that accumulates and stores the information on the manual torque, and the determination unit may determine whether or not the action mode of the manual torque satisfies the predetermined condition based upon the stored information on the manual torque.

The power assist wheelchair includes a wheel, an electric motor that drives the wheel, an encoder that detects rotation of the wheel, and a control device that controls the electric motor. The control device includes a determination unit that determines a type of a traveling environment; and a change unit that changes a predetermined control parameter of the electric motor to a predetermined magnitude based upon the determined type of the traveling environment.

The determination unit may determine the type of the traveling environment based upon the action mode of the manual torque acting on the wheel.

As described above, while the embodiments of the present invention have been described, the present invention is not limited to the above-described embodiments, and it goes without saying that various modifications can be implemented by those skilled in the art.

The invention claimed is:

1. A power assist wheelchair, comprising:

first and second wheels separated from each other in a vehicle width direction;

a first electric motor that drives the first wheel;

a first encoder that detects rotation of the first wheel;

a second electric motor that drives the second wheel;

a second encoder that detects rotation of the second wheel; and a control device that controls the first and second electric motors, wherein the control device includes:

a vehicle speed calculation unit configured to calculate a vehicle speed;

a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor;

an actual turning torque calculation unit configured to calculate an actual turning torque value based upon a detection signal of the first encoder and a detection signal of the second encoder;

a compensation turning torque calculation unit configured to calculate a compensation turning torque value for compensating for at least a part of a shortage or excess of the actual turning torque value with respect to the predicted turning torque value, wherein the compensation turning torque value is smaller when the vehicle speed is a first speed than when the vehicle speed is a second speed faster than the first speed;

a first target current determination unit configured to determine a target current of the first electric motor based upon the first manual torque value and the compensation turning torque value; and a second target current determination unit configured to determine a target current of the second electric motor based upon the second manual torque value and the compensation turning torque value.

2. The power assist wheelchair according to claim 1, wherein the compensation turning torque value is 0 when the vehicle speed is the first speed.

3. The power assist wheelchair according to claim 1, wherein the compensation turning torque value is greater than 0 when the vehicle speed is the first speed.

4. The power assist wheelchair according to claim 1, further comprising:

a sensor that detects an inclination of a vehicle body in the vehicle width direction, wherein the compensation turning torque value is greater when the inclination detected by the sensor is a first inclination angle than when the inclination detected by the sensor is a second inclination angle smaller than the first inclination angle.

5. The power assist wheelchair according to claim 1, wherein the vehicle speed calculation unit calculates the vehicle speed based upon the detection signal of the first encoder and the detection signal of the second encoder.

6. The power assist wheelchair according to claim 1, further comprising:

a first torque sensor that detects the first manual torque value acting on the first wheel; and a second torque sensor that detects the second manual torque value acting on the second wheel.

7. The power assist wheelchair according to claim 1, wherein a coefficient included in a conversion equation for calculating the actual turning torque value is configured to be changeable.

8. The power assist wheelchair according to claim 7, wherein the control device is configured to change the coefficient in response to a command from a terminal capable of communicating with the control device.

9. The power assist wheelchair according to claim 1, further comprising:

a weight sensor that detects a weight of a user sitting on a seat, wherein the actual turning torque calculation unit is configured to calculate the actual turning torque value based upon the detection signal of the first encoder, and the detection signal of the second encoder, and the detected weight.

10. The power assist wheelchair according to claim 1, wherein the control device further includes:

a determination unit configured to determine whether or not an action mode of the manual torque acting on the first and second wheels satisfies a predetermined condition; and a change unit configured to change the compensation turning torque value to a predetermined magnitude when the action mode of the manual torque satisfies the predetermined condition.

11. The power assist wheelchair according to claim 1, wherein the control device further includes:

a determination unit configured to determine a type of a traveling environment; and a change unit configured to change the compensation turning torque value to a predetermined magnitude based upon the determined type of the traveling environment.

12. A power assist unit for a wheelchair, comprising:

first and second wheels separated from each other in a vehicle width direction;

a first electric motor that drives the first wheel;

a first encoder that detects rotation of the first wheel;

a second electric motor that drives the second wheel;

a second encoder that detects rotation of the second wheel; and a control device that controls the first and second electric motors, wherein the control device includes:

a vehicle speed calculation unit configured to calculate a vehicle speed;

a predicted turning torque calculation unit configured to calculate a predicted turning torque value based upon a first manual torque value acting on the first wheel, a first motor torque value outputted by the first electric motor, a second manual torque value acting on the second wheel, and a second motor torque value outputted by the second electric motor;

an actual turning torque calculation unit configured to calculate an actual turning torque value based upon a detection signal of the first encoder and a detection signal of the second encoder;

a compensation turning torque calculation unit configured to calculate a compensation turning torque value for compensating for at least a part of a shortage or excess of the actual turning torque value with respect to the predicted turning torque value, wherein the compensation turning torque value is smaller when the vehicle speed is a first speed than when the vehicle speed is a second speed faster than the first speed;

a first target current determination unit configured to determine a target current of the first electric motor based upon the first manual torque value and the compensation turning torque value; and a second target current determination unit configured to determine a target current of the second electric motor based upon the second manual torque value and the compensation turning torque value.

13. A control method for a power assist wheelchair including first and second wheels separated from each other in a vehicle width direction, a first electric motor that drives the first wheel, a first encoder that detects rotation of the first wheel, a second electric motor that drives the second wheel, and a second encoder that detects rotation of the second wheel, the control method comprising:

calculating a vehicle speed;

calculating a predicted turning torque value based upon a first manual torque value acting on the first wheel, a first motor torque value outputted by the first electric motor, a second manual torque value acting on the second wheel, and a second motor torque value outputted by the second electric motor;

calculating an actual turning torque value based upon a detection signal of the first encoder and a detection signal of the second encoder;

calculating a compensation turning torque value for compensating for at least a part of a shortage or excess of the actual turning torque value with respect to the predicted turning torque value, wherein the compensation turning torque value is smaller when the vehicle speed is a first speed than when the vehicle speed is a second speed faster than the first speed;

determining a target current of the first electric motor based upon the first manual torque value and the compensation turning torque value; and determining a target current of the second electric motor based upon the second manual torque value and the compensation turning torque value.

* * * * *